US009506298B2

(12) United States Patent
Pearce et al.

(10) Patent No.: US 9,506,298 B2
(45) Date of Patent: Nov. 29, 2016

(54) DRILL BITS HAVING BLIND-HOLE FLUSHING AND SYSTEMS FOR USING SAME

(71) Applicant: Longyear TM, Inc., South Jordan, UT (US)

(72) Inventors: Cody A. Pearce, Midvale, UT (US); Michael D. Rupp, Murray, UT (US); Christian M. Lambert, Draper, UT (US)

(73) Assignee: LONGYEAR TM, INC., Salt Lake City, UT (US)

( * ) Notice: Subject to any disclaimer, the term of this patent is extended or adjusted under 35 U.S.C. 154(b) by 320 days.

(21) Appl. No.: 14/085,218

(22) Filed: Nov. 20, 2013

(65) Prior Publication Data

US 2015/0136493 A1 May 21, 2015

(51) Int. Cl.
*E21B 10/42* (2006.01)
*E21B 10/60* (2006.01)

(52) U.S. Cl.
CPC ..... *E21B 10/60* (2013.01); *E21B 10/42* (2013.01)

(58) Field of Classification Search
CPC ..... E21B 10/42; E21B 10/43; E21B 10/60; E21B 10/602; E21B 10/61
USPC ..... 175/398, 400, 424
See application file for complete search history.

(56) References Cited

U.S. PATENT DOCUMENTS 367,946 A 8/1887 Brewer
774,384 A 11/1904 Fisher
1,163,867 A 12/1915 Shaffer
1,572,386 A 2/1926 Gates
2,046,400 A 7/1936 Mitchell
2,147,843 A 2/1939 Jamar et al.
2,147,849 A 2/1939 Leo William
2,342,931 A 2/1944 Fortune
2,493,178 A 1/1950 Williams
2,495,400 A 1/1950 Williams
2,644,672 A 7/1953 Matthews
2,931,630 A 4/1960 Grady
2,966,949 A 1/1961 Wepsala
2,969,122 A 1/1961 Steffes
3,095,935 A 7/1963 Bridwell
3,175,629 A * 3/1965 Rowley ..... E21B 10/46 175/340
3,215,215 A 11/1965 Kellner
3,384,192 A * 5/1968 Goodwin ..... E21B 7/18 175/424

(Continued)

FOREIGN PATENT DOCUMENTS

AU 2007333850 12/2007
AU 2007333850 A1 6/2008

(Continued)

OTHER PUBLICATIONS

U.S. Appl. No. 14/085,242, filed Nov. 20, 2013, Pearce.

(Continued)

*Primary Examiner* — Kenneth L Thompson
(74) *Attorney, Agent, or Firm* — Ballard Spahr LLP

(57) ABSTRACT

A drill bit for forming a hole in a formation. The drill bit has a shank and a full face crown that cooperate to define an interior space that receives water or other drilling fluid. The full face crown defines a plurality of bores that extend from a cutting face of the full face crown to the interior space. The full face crown completely circumferentially encloses the interior space of the drill bit.

20 Claims, 11 Drawing Sheets

(56) References Cited

U.S. PATENT DOCUMENTS

| | | | | |
|---|---|---|---|---|
| RE26,669 | E | 9/1969 | Henderson | |
| 3,495,359 | A | 2/1970 | Smith et al. | |
| 3,692,127 | A | 9/1972 | Hampe et al. | |
| 3,831,753 | A * | 8/1974 | Gaylord | B01D 35/02 175/320 |
| 3,860,354 | A | 1/1975 | Hougen | |
| 4,128,136 | A | 12/1978 | Generoux | |
| 4,186,628 | A | 2/1980 | Bonnice | |
| 4,189,015 | A | 2/1980 | Acker, III et al. | |
| 4,190,126 | A | 2/1980 | Kabashima | |
| 4,208,154 | A | 6/1980 | Gundy | |
| 4,452,554 | A | 6/1984 | Hougen | |
| 4,494,618 | A | 1/1985 | Radtke | 175/393 |
| 4,499,959 | A | 2/1985 | Grappendorf et al. | |
| 4,538,691 | A * | 9/1985 | Dennis | E21B 10/605 175/393 |
| 4,538,944 | A | 9/1985 | Hougen | |
| 4,776,411 | A * | 10/1988 | Jones | E21B 10/006 175/393 |
| 4,822,757 | A | 4/1989 | Sadamori | |
| 4,869,330 | A * | 9/1989 | Tibbitts | E21B 10/46 175/393 |
| 5,025,871 | A | 6/1991 | Stewart et al. | |
| 5,025,875 | A * | 6/1991 | Witt | E21B 10/56 175/393 |
| 5,069,584 | A | 12/1991 | Obermeier et al. | |
| D342,270 | S | 12/1993 | Kwang | |
| 5,316,416 | A | 5/1994 | Kim | |
| 5,628,376 | A | 5/1997 | Kleine | |
| 5,823,276 | A | 10/1998 | Beck, III | |
| 5,836,409 | A | 11/1998 | Vail, III | |
| 5,932,508 | A | 8/1999 | Armstrong et al. | |
| 6,123,490 | A | 9/2000 | Underhill | |
| 6,390,207 | B2 | 5/2002 | Wentworth et al. | |
| 6,474,425 | B1 * | 11/2002 | Truax | E21B 10/26 175/398 |
| 6,595,844 | B1 | 7/2003 | Mizuno et al. | |
| 6,675,919 | B2 | 1/2004 | Mosing et al. | |
| 6,945,339 | B2 | 9/2005 | Hiranuma et al. | |
| 7,055,626 | B2 | 6/2006 | Wells et al. | |
| 7,182,156 | B2 | 2/2007 | Charland et al. | |
| 7,189,036 | B1 | 3/2007 | Watson | |
| 7,341,118 | B2 | 3/2008 | Viel et al. | |
| 7,611,312 | B2 | 11/2009 | Miyanaga | |
| 7,621,350 | B2 | 11/2009 | Richert | |
| 7,628,228 | B2 | 12/2009 | Drivdahl et al. | |
| 7,641,004 | B2 | 1/2010 | Lapointe | |
| D622,745 | S | 8/2010 | Pearce et al. | |
| 7,793,716 | B2 | 9/2010 | Macias et al. | |
| 7,828,090 | B2 | 11/2010 | Drivdahl et al. | |
| 7,874,284 | B2 | 1/2011 | Sano | |
| 7,874,384 | B2 | 1/2011 | Drivdahl et al. | |
| 7,909,119 | B2 | 3/2011 | Drivdahl et al. | |
| 7,918,288 | B2 | 4/2011 | Drivdahl et al. | |
| 7,958,954 | B2 | 6/2011 | Drivdahl et al. | |
| 7,984,773 | B2 | 7/2011 | Oothoudt | |
| D647,114 | S | 10/2011 | Pearce et al. | |
| D647,115 | S | 10/2011 | Pearce et al. | |
| 8,051,929 | B2 | 11/2011 | Drivdahl et al. | |
| D656,167 | S * | 3/2012 | Dunnahoe | D15/131 |
| 8,459,381 | B2 | 6/2013 | Pearce et al. | |
| 8,485,283 | B2 | 7/2013 | Baril et al. | |
| 8,991,524 | B2 | 3/2015 | Pearce et al. | |
| 9,074,429 | B2 | 7/2015 | Pearce et al. | |
| 2002/0011355 | A1 | 1/2002 | Wentworth et al. | 175/19 |
| 2002/0011356 | A1 * | 1/2002 | Hill, III | E21B 10/26 175/57 |
| 2002/0043406 | A1 | 4/2002 | Wentworth et al. | |
| 2002/0175006 | A1 | 11/2002 | Findley et al. | 175/425 |
| 2004/0251054 | A1 | 12/2004 | Charland et al. | 175/385 |
| 2005/0105977 | A1 | 5/2005 | Ishihara | 408/1 R |
| 2007/0065244 | A1 | 3/2007 | Miyanaga | |
| 2007/0246266 | A1 | 10/2007 | Larbo | |
| 2008/0142262 | A1 | 6/2008 | Drivdahl et al. | |
| 2009/0283326 | A1 | 11/2009 | Oothoudt | |
| 2010/0089660 | A1 | 4/2010 | Pearce et al. | |
| 2010/0170720 | A1 | 7/2010 | Baril et al. | 175/3 |
| 2011/0031027 | A1 | 2/2011 | Drivdahl et al. | 175/403 |
| 2012/0061146 | A1 | 3/2012 | Pearce et al. | 175/58 |
| 2012/0125687 | A1 | 5/2012 | Rives | 175/57 |
| 2013/0186693 | A1 | 7/2013 | West et al. | |
| 2014/0216826 | A1 | 8/2014 | Pearce | |
| 2015/0136493 | A1 | 5/2015 | Pearce et al. | |
| 2015/0136494 | A1 | 5/2015 | Pearce et al. | |
| 2015/0184465 | A1 | 7/2015 | Pearce et al. | |

FOREIGN PATENT DOCUMENTS

| | | | |
|---|---|---|---|
| AU | 2010337217 | | 12/2010 |
| AU | 2011201706 | | 4/2011 |
| AU | 2011201707 | | 4/2011 |
| AU | 2011201709 | | 4/2011 |
| AU | 2011201710 | | 4/2011 |
| AU | 2011201711 | | 4/2011 |
| AU | 2011201713 | | 4/2011 |
| AU | 2011201706 | A1 | 5/2011 |
| AU | 2011201707 | A1 | 5/2011 |
| AU | 2011201709 | A1 | 5/2011 |
| AU | 2011201710 | A1 | 5/2011 |
| AU | 2011201713 | A1 | 5/2011 |
| AU | 2011201711 | B1 | 7/2011 |
| AU | 2010337217 | A1 | 7/2012 |
| AU | 2015203268 | | 6/2015 |
| BR | PI1011892-6 | | 12/2010 |
| CA | 2671061 | | 12/2007 |
| CA | 2671061 | A1 | 6/2008 |
| CA | 2826590 | A1 | 6/2008 |
| CA | 03228-2011 | | 12/2010 |
| CA | 2784465 | | 12/2010 |
| CA | 2785465 | A1 | 6/2011 |
| CA | 2826590 | | 9/2013 |
| CN | 2386178 | Y | 7/2000 |
| CN | 1798624 | A | 7/2006 |
| CN | 200780051070.8 | | 12/2007 |
| CN | 101652532 | A | 2/2010 |
| CN | 201080057021.7 | | 12/2010 |
| CN | 102782243 | A | 11/2012 |
| EP | 07869300.9 | | 12/2007 |
| EP | 2122111 | A2 | 11/2009 |
| EP | 10841452.5 | | 12/2010 |
| EP | 2513405 | A1 | 10/2012 |
| NZ | 600930 | | 12/2010 |
| PE | 2055.2011 | | 12/2010 |
| PE | 664.15 | | 5/2015 |
| SU | 1571209 | A1 | 6/1990 |
| WO | WO-01/92677 | A1 | 12/2001 |
| WO | WO-2004/108333 | A1 | 12/2004 |
| WO | WO-2006/004494 | A1 | 1/2006 |
| WO | WO-2006/076795 | A1 | 7/2006 |
| WO | PCT/US2007/087619 | | 12/2007 |
| WO | WO-2008/076908 | A2 | 6/2008 |
| WO | PCT/US2010/058871 | | 12/2010 |
| WO | WO-2011/068929 | A2 | 6/2011 |
| WO | WO 2011/081775 | | 7/2011 |
| WO | WO-2011/081775 | A1 | 7/2011 |
| WO | PCT/US2014/066547 | | 11/2014 |
| WO | PCT/US2014/066690 | | 11/2014 |
| WO | WO PCT/US2014/066547 | | 11/2014 |
| WO | WO PCT/US2014/066690 | | 11/2014 |
| WO | PCT/US2014/072683 | | 12/2014 |
| WO | PCT/US2015/024515 | | 4/2015 |
| WO | WO-2015/077413 | A1 | 5/2015 |
| WO | WO-2015/077494 | A1 | 5/2015 |
| WO | WO-2015/103213 | A1 | 7/2015 |
| ZA | 2009/03801 | | 12/2007 |
| ZA | 2009/03801 | A | 8/2010 |

(56) References Cited

FOREIGN PATENT DOCUMENTS

| | | |
|---|---|---|
| ZA | 2012/05225 | 12/2010 |
| ZA | 2013/07869 | 12/2013 |

OTHER PUBLICATIONS

Issue Notification dated Dec. 8, 2009 for U.S. Appl. 11/610,680, filed May 29, 2000 and issued as U.S. Pat. No. 7,628,228 (Inventor: Drivdahl // Applicant: Boart Longyear) (1 page).
Notice of Allowance dated Sep. 30, 2009 for U.S. Appl. 11/610,680, filed May 29, 2000, issued as U.S. Pat. No. 7,628,228 (Inventor: Drivdahl // Applicant: Boart Longyear) (4 pages).
Response and Amendment to Final Office Action dated Sep. 22, 2009 for U.S. Appl. No. 11/610,680, filed May 29, 2000, issued as U.S. Pat. No. 7,628,228 (Inventor: Drivdahl // Applicant: Boart Longyear) (7 pages).
Final Rejection issued Jul. 7, 2009 for U.S. Appl. No. 11/610,680, filed May 29, 2000, issued as U.S. Pat. No. 7,628,228 (Inventor: Drivdahl //Applicant: Boart Longyear ) (6 pages).
Response to Restriction Requirement dated Apr. 16, 2009 for U.S. Appl. No. 11/610,680, filed May 29, 2000, issued as U.S. Pat. No. 7,628,228 (Inventor: Drivdahl// Boart Longyear) (3 pages).
Restriction Requirement dated Mar. 18, 2009 for U.S. Appl. No. 11/610,680, filed May 29, 2000, issued as U.S. Pat. No. 7,628,228 (Inventor: Drivdahl// Applicant: Boar Longyear) (7 pages).
Amendment after Non-Final Rejection dated Nov. 24, 2008 for U.S. Appl. No. 11/610,680, filed May 29, 2000, issued as U.S. Pat. No. 7,628,228 (Inventor: Drivdahl// Applicant: Boart Longyear) (20 pages).
Examiner Interview Summary dated Nov. 13, 2008 for U.S. Appl. No. 11/610,680, filed May 29, 2000, issued as U.S. Pat. No. 7,628,228 (Inventor: Drivdahl//Applicant: Boart Longyear) (1 page).
Non-Final Office Action dated Jul. 28, 2008 for U.S. Appl. No. 11/610,680, filed May 29, 2000, issued as U.S. Pat. No. 7,628,228 (Inventor: Drivdahl// Applicant: Boart Longyear) (7 pages).
Preliminary Amendment dated May 23, 2009 for U.S. Appl. No. 11/610,680, filed May 29, 2000, issued as U.S. Pat. No. 7,628,228 (Inventor: Drivdahl// Applicant: Boart Longyear) (6 pages).
Issue Notification dated Novemeber 9, 2010 from U.S. Appl. No. 12/564,540, filed Sep. 22, 2009, issued as U.S. Pat. No. 7,828,090 (Inventor: Drivdahl// Applicant: Boart Longyear) (1 page).
Supplemental Notice of Allowance dated Sep. 29, 2010 from U.S. Appl. No. 12/564,540, filed Sep. 22, 2009, issued as U.S. Pat. No. 7,828,090 (Inventor: Drivdahl// Applicant: Boart Longyear) (2 pages).
Notice of Allowance dated Sep. 1, 2010 from U.S. Appl. No. 12/564,540, filed Sep. 22, 2009, issued as U.S. Pat. No. 7,828,090 (Inventor: Drivdahl// Applicant: Boart Longyear) (4 pages).
Amendment and Response to Office Action dated Jul. 26, 2010 from U.S. Appl. No. 12/564,540, filed Sep. 22, 2009, issued as U.S. Pat. No. 7,828,090 (Inventor: Drivdahl// Applicant: Boart Longyear) (12 pages).
Examiner Interview Summary dated Jun. 10, 2010 for U.S. Appl. No. 12/564,540, filed Sep. 22, 2009, issued as U.S. Pat. No. 7,828,090 (Inventor: Drivdahl// Applicant: Boart Longyear) (1 page).
Non-Final Office Action dated Apr. 26, 2010 for U.S. Appl. No. 12/564,540, filed Sep. 22, 2009, issued as U.S. Pat. No. 7,828,090 (Inventor: Drivdahl// Applicant: Boart Longyear) (7 pages).
Issue Notification dated Apr. 5, 2011 for U.S. Appl. No. 12/564,779, filed May 29, 2000, issued as U.S. Pat. No. 7,918,288 (Inventor: Drivdahl// Applicant: Boart Longyear) (1 page).
Supplemental Notice of Allowance dated Feb. 23, 2011 for U.S. Appl. No. 12/564,779, filed May 29, 2000, issued as U.S. Pat. No. 7,918,288 (Inventor: Drivdahl// Applicant: Boart Longyear) (2 pages).
Notice of Allowance dated Jan. 21, 2011 for U.S. Appl. No. 12/564,779, filed May 29, 2000, issued as U.S. Pat. No. 7,918,288 (Inventor: Drivdahl// Applicant: Boart Longyear) (4 pages).
Amendment and Response to Office Action dated Dec. 7, 2010 for U.S. Appl. No. 12/564,779, filed May 29, 2000, issued as U.S. Pat. No. 7,918,288 (Inventor: Drivdahl// Applicant: Boart Longyear) (14 pages).
Examiner Interview Summary dated Oct. 19, 2010 for U.S. Appl. No. 12/564,779, filed May 29, 2000, issued as U.S. Pat. No. 7,918,288 (Inventor: Drivdahl// Applicant: Boart Longyear) (1 page).
Non-Final Office Action dated Sep. 7, 2010 for U.S. Appl. No. 12/564,779, filed May 29, 2000, issued as U.S. Pat. No. 7,918,288 (Inventor: Drivdahl// Applicant: Boart Longyear) (10 pages).
Notice of Allowance dated Jul. 19, 2010for U.S. Appl. 12/564,779, filed May 29, 2000, issued as U.S. Pat. No. 7,918,288 (Inventor: Drivdahl// Applicant: Boart Longyear) (4 pages).
Amendment and Response to Office Action dated Jun. 23, 2010 for U.S. Appl. No. 12/564,779, filed May 29, 2000, issued as U.S. Pat. No. 7,918,288 (Inventor: Drivdahl// Applicant: Boart Longyear) (13 pages).
Examiner interview Summary dated Jun. 10, 2010 for U.S. Appl. No. 12/564,779, filed May 29, 2000, issued as U.S. Pat. No. 7,918,288 (Inventor: Drivdahl// Applicant: Boart Longyear) (3 pages).
Non-Final Office Action dated Feb. 25, 2010 for U.S. Appl. 12/564,779, filed May 29, 2000, issued as U.S. Pat. No. 7,918,288 (Inventor: Drivdahl// Applicant: Boart Longyear) (10 pages).
Issue Notification dated Nov. 8, 2011 for U.S. Appl. No. 12/909,187, filed Oct. 21, 2010 and issued as U.S. Pat. No. 8,051,929 (Inventor: Drivdahl// Applicant: Boart Longyear.1) (1 page).
Supplemental Notice of Allowance dated Sep. 28, 2011 for U.S. Appl. No. 12/909,187, filed Oct. 21, 2010 and issued as U.S. Pat. No. 8,051,929 (Inventor: Drivdahl// Applicant: Boart Longyear.1) (2 pages).
Supplemental Notice of Allowance dated Aug. 10, 2011 for U.S. Appl. No. 12/909,187, filed Oct. 21, 2010 and issued as U.S. Pat. No. 8,051,929 (Inventor: Drivdahl// Applicant: Boart Longyear.1) (5 pages).
Notice of Allowance dated Jun. 2, 2011 for U.S. Appl. No. 12/909,187, filed Oct. 21, 2010 and issued as U.S. Pat. No. 8,051,929 (Inventor: Drivdahl// Applicant: Boart Longyear.1) (5 pages).
Amendment and Response to Office Action dated Mar. 28, 2011 for U.S. Appl. No. 12/909,187, filed Oct. 21, 2010 and issued as U.S. Pat. No. 8,051,929 (Inventor: Drivdahl// Applicant: Boart Longyear. 1) (12 pages).
Examiner Interview Summary dated Jan. 20, 2011 for for U.S. Appl. No. 12/909,187, filed Oct. 21, 2010 and issued as U.S. Pat. No. 8,051,929 (Inventor: Drivdahl// Applicant: Boart Longyear.1) (3 pages).
Non-Final Office Action dated Dec. 27, 2010 for U.S. Appl. No. 12/909,187, filed Oct. 21, 2010 and issued as U.S. Pat. No. 8,051,929 (Inventor: Drivdahl// Applicant: Boart Longyear) (14 pages).
Issue Notification dated Jun. 14, 2011 for U.S. Appl. No. 12/567,477, which was filed Sep. 25, 2009 and issued as U.S. Pat. No. 7,958,954 on Jun. 14, 2011 (Inventor—Drivdahl; Applicant—Boart Longyear) (1 page).
Supplemental Notice of Allowance dated May 10, 2011 for U.S. Appl. No. 12/567,477, which was filed Sep. 25, 2009 and issued as U.S. Pat. No. 7,958,954 on Jun. 14, 2011 (Inventor—Drivdahl; Applicant—Boart Longyear) (2 pages).
Supplemental Notice of Allowance dated Mar. 25, 2011 for U.S. Appl. No. 12/567,477, which was filed Sep. 25, 2009 and issued as U.S. Pat. No. 7,958,954 on Jun. 14, 2011 (Inventor—Drivdahl; Applicant—Boart Longyear) (2 pages).
Notice of Allowance dated Feb. 9, 2011 for U.S. Appl. No. 12/567,477, which was filed Sep. 25, 2009 and issued as U.S. Pat. No. 7,958,954 on Jun. 14, 2011 (Inventor—Drivdahl; Applicant—Boart Longyear) (6 pages).

(56) References Cited

OTHER PUBLICATIONS

Amendment and Response to Office Action dated Dec. 21, 2010 for U.S. Appl. No. 12/567,477, which was filed Sep. 25, 2009 and issued as U.S. Pat. No. 7,958,954 on Jun. 14, 2011 (Inventor—Drivdahl; Applicant—Boart Longyear) (12 pages).
Examiner Interview Summary dated Oct. 19, 2010 for U.S. Appl. No. 12/567,477, which was filed Sep. 25, 2009 and issued as U.S. Pat. No. 7,958,954 on Jun. 14, 2011 (Inventor—Drivdahl; Applicant—Boart Lognyear) (2 pages).
Non-Final Office Action dated Sep. 21, 2010 for U.S. Appl. No. 12/567,477, which was filed Sep. 25, 2009 and issued as U.S. Pat. No. 7,958,954 on Jun. 14, 2011 (Inventor—Drivdahl; Applicant—Boart Longyear) (8 pages).
Amendment and Response to Non-Final Office Action dated Sep. 1, 2010 U.S. Appl. No. 12/567,477, which was filed Sep. 25, 2009 and issued as U.S. Pat. No. 7,958,954 on Jun. 14, 2011 (Inventor—Drivdahl; Applicant—Boart Longyear) (5 pages).
Examiner Interview Summary dated Aug. 13, 2010 for U.S. Appl. No. 12/567,477, which was filed Sep. 25, 2009 and issued as U.S. Pat. No. 7,958,954 on Jun. 14, 2011(Inventor—Drivdahl; Applicant—Boart Longyear) (2 pages).
Non-Final Office Action dated Jun. 1, 2010 for U.S. Appl. No. 12/567,477, filed Sep. 25, 2009 and issued as U.S. Pat. No. 7,958,954 (Inventor—Drivdahl; Applicant—Boart Longyear) (9 pages).
Issue Notification dated Mar. 2, 2011 from U.S. Appl. No. 12/568,204, which was filed on Sep. 28, 2009, issued as 7,909,119 on Mar. 22, 2011 (Inventor—Drivdahl; Applicant—Boart Longyear) (1 page).
Supplemental Notice of Allowance dated Feb. 23, 2011 for U.S. Appl. No. 12/568,204, which was filed on Sep. 28, 2009, issued as 7,909,119 on Mar. 22, 2011 (Inventor—Drivdahl; Applicant—Boart Longyear) (2 pages).
Examiner Interview Summary dated Nov. 26, 2011 for U.S. Appl. No. 12/568,204, which was filed on Sep. 28, 2009, issued as 7,909,119 on Mar. 22, 2011 (Inventor—Drivdahl; Applicant—Boart Longyear) (1 page).
Notice of Allowance dated Nov. 26, 2011 for U.S. Appl. No. 12/568,204, which was filed on Sep. 28, 2009, issued as 7,909,119 on Mar. 22, 2011 (Inventor—Drivdahl; Applicant—Boart Longyear) (3 pages).
Amendment and Response to Final Office action dated Oct. 27, 2010 for U.S. Appl. No. 12/568,204, which was filed Sep. 28, 2009, issued as 7,909,119 on Mar. 22, 2011 (Inventor—Drivdahl; Applicant—Boart Longyear) (13 pages).
Examiner Interview Summary dated Oct. 19, 2010 for U.S. Appl. No. 12/568,204, which was filed on Sep. 28, 2009, issued as 7,909,119 on Mar. 22, 2011 (Inventor—Drivdahl; Applicant—Boart Lognyear) (2 pages).
Final Office Action dated Aug. 23, 2010 U.S. Appl. No. 12/568,204, which was filed Sep. 28, 2009, issued as 7,909,119 on Mar. 22, 2011 (Inventor—Drivdahl; Applicant—Boart Longyear) (9 pages).
Amendment and Response to Non-Final Office Action dated Jul. 8, 2010 for U.S. Appl. No. 12/568,204 which was filed Sep. 28, 2009, issued as 7,909,119 on Mar. 22, 2011 (Inventor—Drivdahl; Applicant—Boart Longyear) (14 pages).
Examiner Interview Summary dated Jun. 10, 2010 for U.S. Appl. No. 12/568,204, which was filed Sep. 28, 2009, issued as 7,909,119 on Mar. 22, 2011 (Inventor—Drivdahl; Applicant—Boart Longyear) (1 page).
Non-Final Office Action dated Mar. 8, 2010 for U.S. Appl. No. 12/568,204, which was filed Sep. 28, 2009, issued as 7,909,119 on Mar. 22, 2011 (Inventor—Drivdahl et al.; Applicant—Boart Longyear) (10 pages).
Issue Notification dated Jan. 5, 2011 for U.S. Appl. No. 12/568,231, which was filed Sep. 28, 2009 and issued as U.S. Pat. No. 7,874,384 on Jan. 25, 2011 (Inventor—Drivdahl et al.; Applicant—Boart Longyear) (1 page).
Supplemental Notice of Allowance dated Nov. 10, 2011 for U.S. Appl. No. 12/568,231, which was filed Sep. 28, 2009 and issued as U.S. Pat. No. 7,874,384 on Jan. 25, 2011 (Inventor—Drivdahl et al.; Applicant—Boart Longyear (2 pages).
Notice of Allowance dated Sep. 30, 2010 for U.S. Appl. No. 12/568,231, which was filed on Sep. 28, 2009 and issued as U.S. Pat. No. 7,874,384 on Jan. 25, 2011 (Inventor—Drivdahl et al.; Applicant—Boart Longyear) (4 pages).
Amendment and Response to Office Action dated Sep. 3, 2010 for U.S. Appl. No. 12/568,231, which was filed on Sep. 28, 2009 and issued as U.S. Pat. No. 7,874,384 on Jan. 25, 2011 (Inventor—Drivdahl et al.; Applicant—Boart Longyear) (11 pages).
Examiner Interview Summary dated Aug. 13, 2010 for U.S. Appl. No. 12/568,231, which was filed Sep. 28, 2009 and issued as U.S. Pat. No. 7,874,384 on Jan. 25, 2011 (Inventor—Drivdahl et al.; Applicant—Boart Longyear) (2 pages).
Non-Final Office Action dated Jun. 3, 2010 for U.S. Appl. No. 12/568,231, which was filed on Sep. 28, 2009 and issued as U.S. Pat. No. 7,874,384 on Jan. 25, 2011 (Inventor—Drivdahl et al.; Applicant—Boart Longyear) (7 pages).
International Preliminary Report on Patentability issued Jun. 19, 2012 for International patent Application PCT/US2010/058871 and published as WO 2011/081775 on Jul. 7, 2011 (Inventor—Pearce et al.; Applicant—Boart Longyear) (4 pages).
Written Opinion of the International Search Authority mailed Jun. 7, 2011 for International patent Application PCT/US2010/058871 and published as WO 2011/081775 on Jul. 7, 2011 (Inventor—Pearce et al.; Applicant—Boart Longyear) (3 pages).
International Search Report issued Jun. 7, 2011 for International patent Application PCT/US2010/058871 and published as WO 2011/081775 on Jul. 7, 2011 (Inventor—Pearce et al.; Applicant—Boart Longyear) (3 pages).
Issue Notification dated May 22, 2013 for U.S. Appl. No. 12/638,229, which was filed Dec. 15, 2009 and granted as 8,459,381 on Jun. 11, 2013 (Inventor—Pearce et al.; Applicant—Boart Longyear) (1 page).
Notice of Allowance mailed Feb. 14, 2013 for U.S. Appl. No. 12/638,299, which was filed Dec. 15, 2009 and issued as 8,459,381 on Jun. 11, 2013 (Inventor—Pearce et al.; Applicant—Boart Longyear) (7 pages).
Response to Non-Final Office Action mailed Oct. 18, 2012 for U.S. Appl. No. 12/638,299, which was filed on Dec. 15, 2009 and issued as 8,459,381 on Jun. 11, 2013 (Inventor—Pearce et al.; Applicant—Boart Longyear) (11 pages).
Non-Final Office Action issued Jul. 18, 2012 for U.S. Appl. No. 12/638,299, which was filed on Dec. 15, 2009 and issued as 8,459,381 on Jun. 11, 2013 (Inventor—Pearce et al.; Applicant—Boart Longyea) (8 pages).
Response to Restriction Requirement mailed Apr. 23, 2012 for U.S. Appl. No. 12/638,299, which was filed on Dec. 15, 2009 and issued as 8,459,381 on Jun. 11, 2013 (Inventor—Pearce et al.; Applicant—Boart Longyear) (11 pages).
Restriction Requirement mailed Mar. 23, 2912 for U.S. Appl. No. 12/638,299, which was filed on Dec. 15, 2009 and issued as 8,459,381 on Jun. 11, 2013 (Inventor—Pearce et al.; Applicant—Boart Longyear) (8 pages).
Issue Notification dated Sep. 28, 2011 from U.S. Appl. No. 29/354,586, which was filed on Jan. 26, 2010 and issued as D647,114 on Oct. 18, 2011 (Inventor—Rupp et al.) (1 page).
Notice of Allowance dated Aug. 4, 2011 from U.S. Appl. No. 29/354,586, which was filed on Jan. 26, 2010 and issued as D647,114 on Oct. 18, 2011 (Inventor—Rupp et al.) (8 pages).
Office Action dated Oct. 13, 2010 from U.S. Appl. No. 29/354,586, which was filed Jan. 26, 2010 and issued as D647,114 on Oct. 18, 2011 (Inventor—Rupp et al.) (19 pages).
Notice of Allowance dated Aug. 4, 2011 from U.S. Appl. No. 29/354,592, which was filed on Jan. 26, 2010 and issued as D647,115 on Oct. 18, 2011 (Inventor—Rupp et al.) (8 pages).
Notice of Allowance dated Jul. 19, 2011 from U.S. Appl. No. 29/354,592, which was filed Jan. 26, 2010 and issued as D647,115 on Oct. 18, 2011 (Inventor—Rupp et al.) (8 pages).
Notice of Allowance dated Apr. 5, 2010 from U.S. Appl. No. 29/354,579, which was filed on Jan. 26, 2010 and issued as D622,745 on Aug. 31, 2010 (Inventor—Pearce et al.) (10 pages).

(56) References Cited

OTHER PUBLICATIONS

Issue Notification dated Aug. 11, 2010 from U.S. Appl. No. 29/354,579, which was filed Jan. 26, 2010 and issued as D622,745 on Aug. 31, 2010 (Inventor—Pearce et al.) (1 page).
Notice of Allowance dated Jun. 1, 2010 from U.S. Appl. No. 29/354,579, which was filed on Jan. 26, 2010 and issued as D622,745 on Aug. 31, 2010 (Inventor—Pearce et al.) (8 pages).
International Preliminary Report on Patentability issued Jun. 16, 2009 for International Patent Application PCT/US2007/087619 which was filed Dec. 14, 2007 and published as WO 2008/076908 on Jun. 26, 2008 (Inventor—Drivdahl; Applicant—Boart Longyear) (1 page).
Written opinion issued Aug. 1, 2008 for International Patent Application PCT/US2007/087619, which was filed Dec. 14, 2007 and published as WO 2008/076908 on Jun. 26, 2008 (Inventor—Drivdahl; Applicant—Boart Longyear) (4 pages).
Boart Longyear, Alpha Bit, 2003 (1 page).
Issue Notification issued on Jul. 7, 2015 by the U.S. Patent and Trademark Office for U.S. Appl. No. 13/914,233, which was filed on Jun. 10, 2013 and issued as 9,074,429 on Jul. 7, 2015 (Inventor—Pearce et al.; Applicant—Boart Longyear) (1 page).
Notice of Allowance mailed Apr. 21, 2015 by the U.S. Patent and Trademark Office for U.S. Appl. No. 13/914,233, which was filed Jun. 10, 2013 and issued as U.S. Pat. No. 9,0744,29 on Jul. 7, 2015 (Inventor—Pearce et al.; Applicant—Boart Longyear) (8 Pages).
Notice of Allowance mailed Sep. 17, 2014 by the U.S. Patent and Trademark Office for U.S. Appl. No. 13/914,233, which was filed Jul. 10, 2013 and issued as 9,074,429 on Jul. 7, 2015 (Inventor—Pearce et al.; Applicant—Boart Longyear) (5 pages).
Amendment and Response to Non-Final Office Action mailed Aug. 11, 2014 by the U.S. Patent and Trademark Office for U.S. Appl. No. 13/914,233, which was filed Jun. 10, 2013 and issued as U.S. Pat. No. 9,074,429 on Jul. 7, 2015 (Inventor—Pearce et al.; Applicant—Boart Longyear) (9 pages).
Non-Final Office Action issued May 9, 2014 by the U.S. Patent and Trademark Office for U.S. Appl. No. 13/914,233, which was filed Jun. 10, 2013 and issued as 9,074,429 on Jul. 7, 2015 (Inventor—Pearce et al.; Applicant—Boart Longyear) (7 pages).
Amendment and Response to Non-Final Office Action mailed Dec. 30, 2013 by the U.S. Patent and Trademark Office for U.S. Appl. No. 13/914,233, which was filed Jun. 10, 2013 and issued as U.S. Pat. No. 9,074,429, on Jul. 7, 2015 (Inventor—Pearce et al.; Applicant—Boart Longyear) (9 pages).
Non-Final Office Action issued Sep. 30, 2013 by the U.S. Patent and Trademark Office for U.S. Appl. No. 13/914,233, which was filed Jun. 10, 2013 and issued as U.S. Pat. No. 9,074,429 on Jul. 7, 2015 (Inventor—Pearce et al.; Applicant—Boart Longyear) (5 pages).
Written Opinion and International Search Report issued Apr. 10, 2015 for Application No. PCT/US2014/072683, which was filed Dec. 30, 2014 and published as WO 2015/103213 on Jul. 9, 2015 (Inventor—Pearce et al.; Applicant—Boart Longyear) (15 pages).
International Search Report and Written Opinion issued by the International Searching Authority on Mar. 31, 2015 for application PCT/US2014/066690, filed on Nov. 20, 2014 and published as WO 2015/077494 on May 28, 2015 (Applicant—Longyear TM, Inc. // Inventor—Pearce, et al.) (11 pages).
International Search Report and Written Opinion issued by the International Searching Authority on Jul. 13, 2015 for application PCT/US2015/024515, filed on Apr. 6, 2015 (Applicant—Longyear TM, Inc.//Inventor—Pearce, et al.) (13 pages).
U.S. Appl. No. 14/753,853, filed Jun. 29, 2015, Cody A. Pearce.
Written Opinion and International Search Report issued Mar. 31, 2015 for Application No. PCT/US2014/066690, which was filed Nov. 20, 2014 (Applicant—Longyear TM, Inc.//1st Named Inventor—Pearce) (8 pages).
Written Opinion and International Search Report issued Feb. 26, 2015 for Application No. PCT/US2014/066547, which was filed Nov. 20, 2014 (Applicant—Longyear TM, Inc.//1st Named Inventor—Pearce) (12 pages).
Fourth Office Action issued on Jan. 5, 2016 by the State Intellectual Property Office of the People's Republic of China for application 201080057021.7, filed on Dec. 3, 2010 and published as CN102782243A on Nov. 14, 2012 (Applicant—Longyear TM, Inc. // Inventor—Pearce, et al.) (Original—9 pages // Translation 17 pages).
Fifth Office Action was issued on Jun. 22, 2016 by the State Intellectual Property Office of People's Republic of China, which was filed on Dec. 3, 2010 and published as CN102782243A on Nov. 14, 2012 (Inventor—Cody A. Pearce et al; Applicant—Longyear TM, Inc.) (Original 3 pages // Translated 4 pages).
Communication Pursuant to Article 94(3) EPC mailed on Jan. 14, 2016 by the European Patent Office for EP Application No. 07869300.9, which was filed on Dec. 14, 2007 and published as 2122111 on Dec. 5, 2009 (Inventor—K. Shayne Drivdahl; Applicant—Longyear TM, Inc.) (6 pages).
Response to Office Action was mailed in May 12, 2016 to the European Patent Office for EP Application No. 07869300.9, which was filed on Dec. 14, 2007 and published as 2122111 on Dec. 5, 2009 (Inventor—K. Shayne Drivdahl; Applicant—Longyear TM, Inc.).
International Preliminary Report on Patentability issued on Jul. 5, 2016 for Application No. PCT/US2014/072683, which was filed on Dec. 30, 2014 (Inventor—Cody A. Pearce et al; Applicant-Longyear TM, Inc.) (10 pages).
International Preliminary Report on Patentability issued on May 24, 2016 for Application No. PCT/US2014/066690, which was filed on Nov. 20, 2014 and published as WO2015/077494 on May 28, 2015 (Inventor—Cody A. Pearce et al; Applicant—Longyear TM, Inc.) (6 pages).
International Preliminary Report on Patentability issued on May 26, 2016 for Application No. PCT/US2014/066547, which was filed on Nov. 20, 2014 and published as WO 2015/077413 on May 28, 2015 (Inventor—Cody A. Pearce et al; Applicant—Longyear TM, Inc.) (11 pages).

* cited by examiner

DRILL BITS HAVING BLIND-HOLE FLUSHING AND SYSTEMS FOR USING SAME

FIELD

This invention relates to drill bits for forming a hole in a formation, and, more particularly, to full-face drill bits for forming a hole in a formation.

BACKGROUND

Existing drill bits typically have a central waterway and a series of channels that provide fluid communication between a side surface of the bit and the central waterway (with no channels positioned directly on the cutting surface of the bit). The central waterway is needed to permit removal of cuttings over the entire face of the drill bit. These existing drill bits do not permit direct flow of water on the cutting surface of the bits. The lack of water on the cutting surface results in a decrease in the rate at which cuttings are removed, thereby leading to an increase in the wear of the cutting surface. Additionally, the lack of water flow can also minimize the removal of heat from the cutting surface during high-rotational operation of the bit. These known drill bit designs are also associated with relatively low penetration rates and reduced contact stress measurements.

Thus, there is a need in the pertinent art for drill bits that more effectively provide high velocity fluid flow to the cutting surface of the bit and remove heat from the cutting surface. There is a further need in the pertinent art for drill bits that provide increased cutting removal rates and penetration rates in comparison to conventional drill bits.

SUMMARY

Described herein is a drill bit for forming a hole in a formation. The drill bit has a longitudinal axis, a shank, and a full face crown. The full face crown has a cutting face and an outer surface. The full face crown and the shank cooperate to define an interior space about the longitudinal axis. The interior space can be configured to receive water or other drilling fluid during use of the drill bit.

In one aspect, the full face crown can define a plurality of bores extending from the cutting face to the interior space. The full face crown can completely circumferentially enclose the interior space. In exemplary aspects, the full face crown does not have waterways extending radially between the outer surface of the full face crown and the interior space. Optionally, the outer surface of the full face crown can define a plurality of channels extending radially inwardly toward the longitudinal axis. Systems for forming a hole in a formation using the drill bit are also described.

In a further aspect, the full face crown can define a slot extending therein the cutting face of the outer surface of the full face crown that is configured to allow for the fracture and ejection of desired core samples. In an exemplary aspect, a conduit in communication with the interior space and the pressurized drilling fluid can be positioned in communication with a portion of the defined slot such that a desired amount of drilling fluid can be delivered into the slot during a drilling operation.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE FIGURES

These and other features of the preferred embodiments of the invention will become more apparent in the detailed description in which reference is made to the appended drawings wherein.

Figure 9:
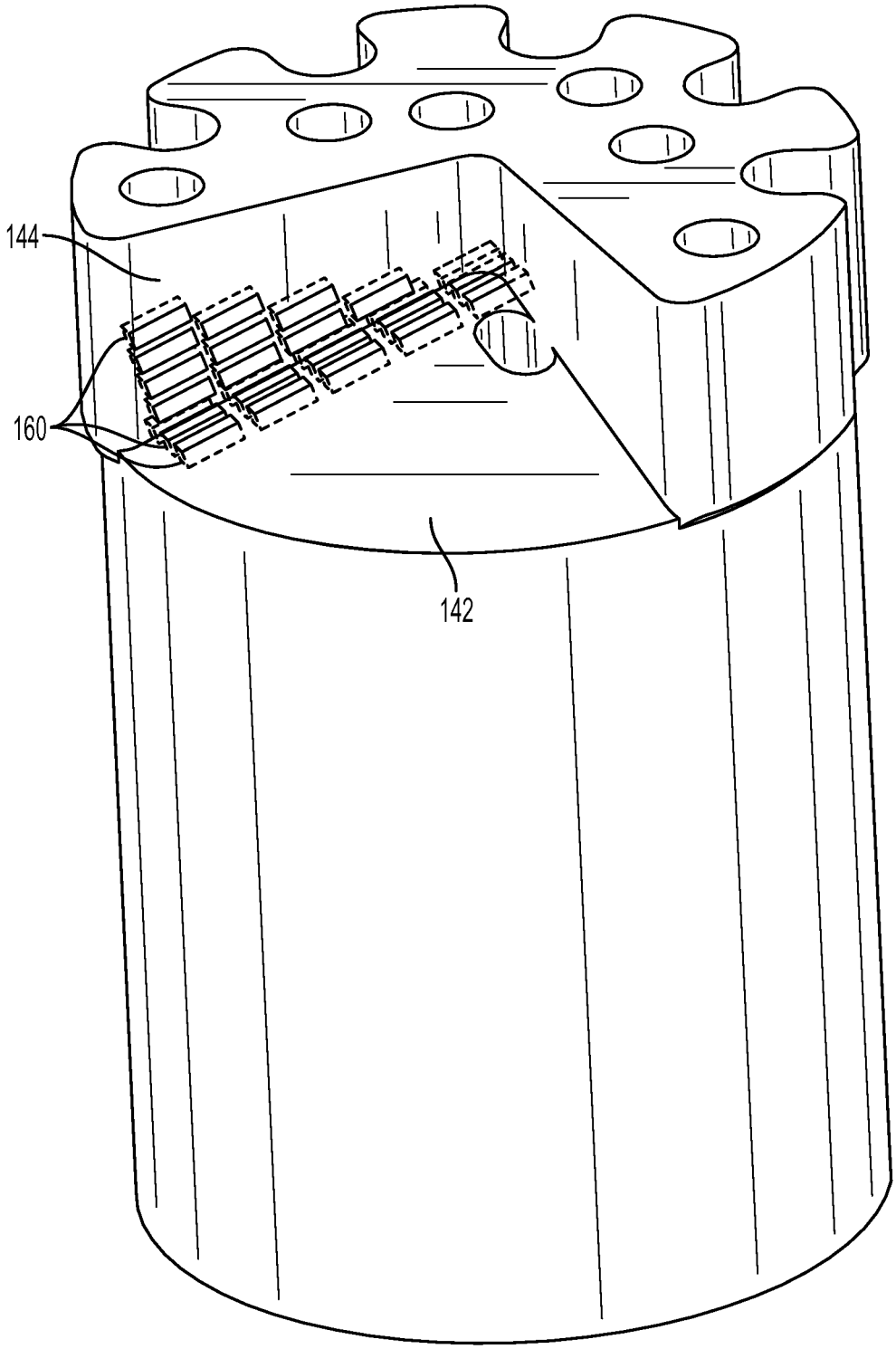

FIG. 9 is a top, partially transparent perspective view of a fourth embodiment of an exemplary drill bit as disclosed herein. As depicted, a plurality of wear-resistant members are partially embedded therein portions of the bottom and side surfaces that define the slot of the drill bit. Portions of the wear-resistant members that are embedded within the bottom and side surfaces are shown in broken line, while portions of the plurality of wear resistant members that extend from the bottom and side surfaces are shown in solid line.

Figure 10:
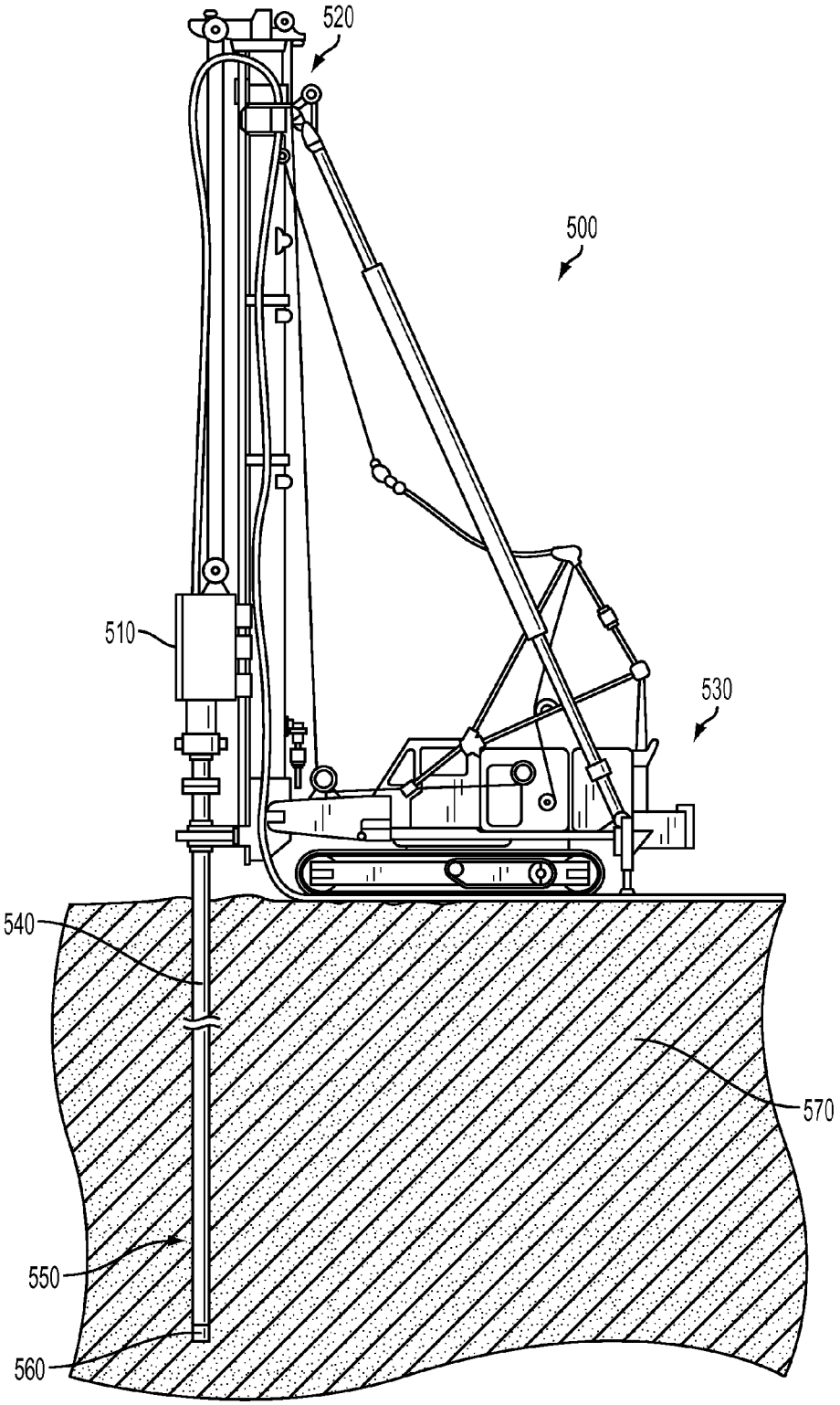

FIG. 10 is a schematic view of a drilling system having a drill bit as disclosed herein.

DETAILED DESCRIPTION

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a bore" can include two or more such bores unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

Figure 1:
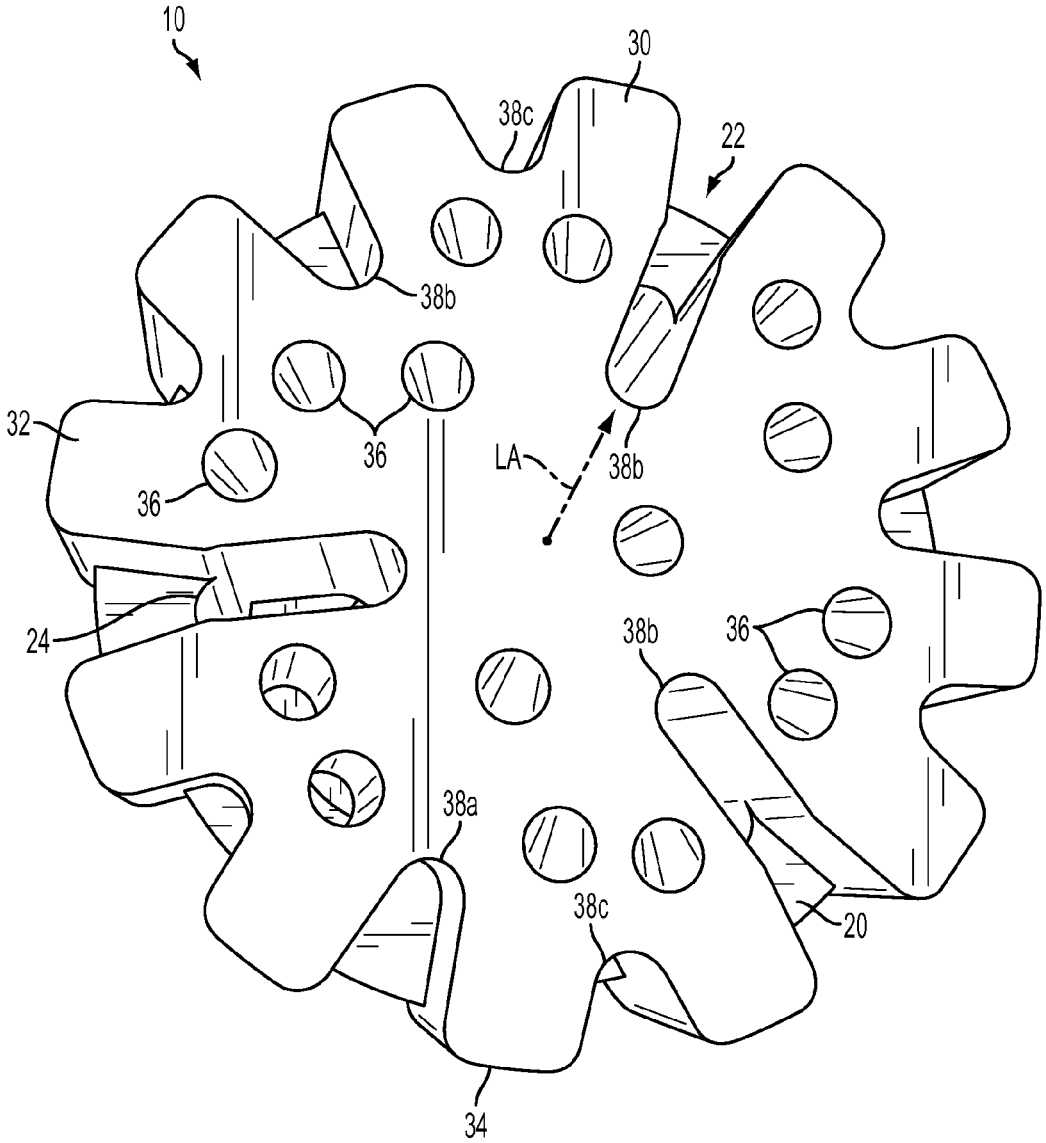
FIG. 1 is a top perspective view of an exemplary drill bit as disclosed herein.

Described herein with reference to FIG. 1 is a drill bit 10 for forming a hole in a formation. The drill bit 10 has a longitudinal axis LA. In exemplary aspects, the drill bit 10 can comprise a shank 20 and a full face crown 30. It is contemplated that the drill bits disclosed herein can provide an improved penetration rate relative to conventional drill bits. It is further contemplated that the drill bits disclosed herein can provide enhanced chip/cutting removal and enhanced cooling of the cutting face of the bit, as measured relative to conventional drill bits. It is still further contemplated that the drill bits disclosed herein can provide improved wear resistance relative to conventional drill bits.

In exemplary aspects, the drill bits disclosed herein can be full-face bits. In these aspects, it is contemplated that the full face drill bits disclosed herein can be plug and/or non-coring bits. In still further exemplary aspects, it is contemplated that the drill bits disclosed herein can be concave-faced drill bits. In still further exemplary aspects, it is contemplated that the drill bits disclosed herein can be non-concave faced drill bits.

Figure 2A:
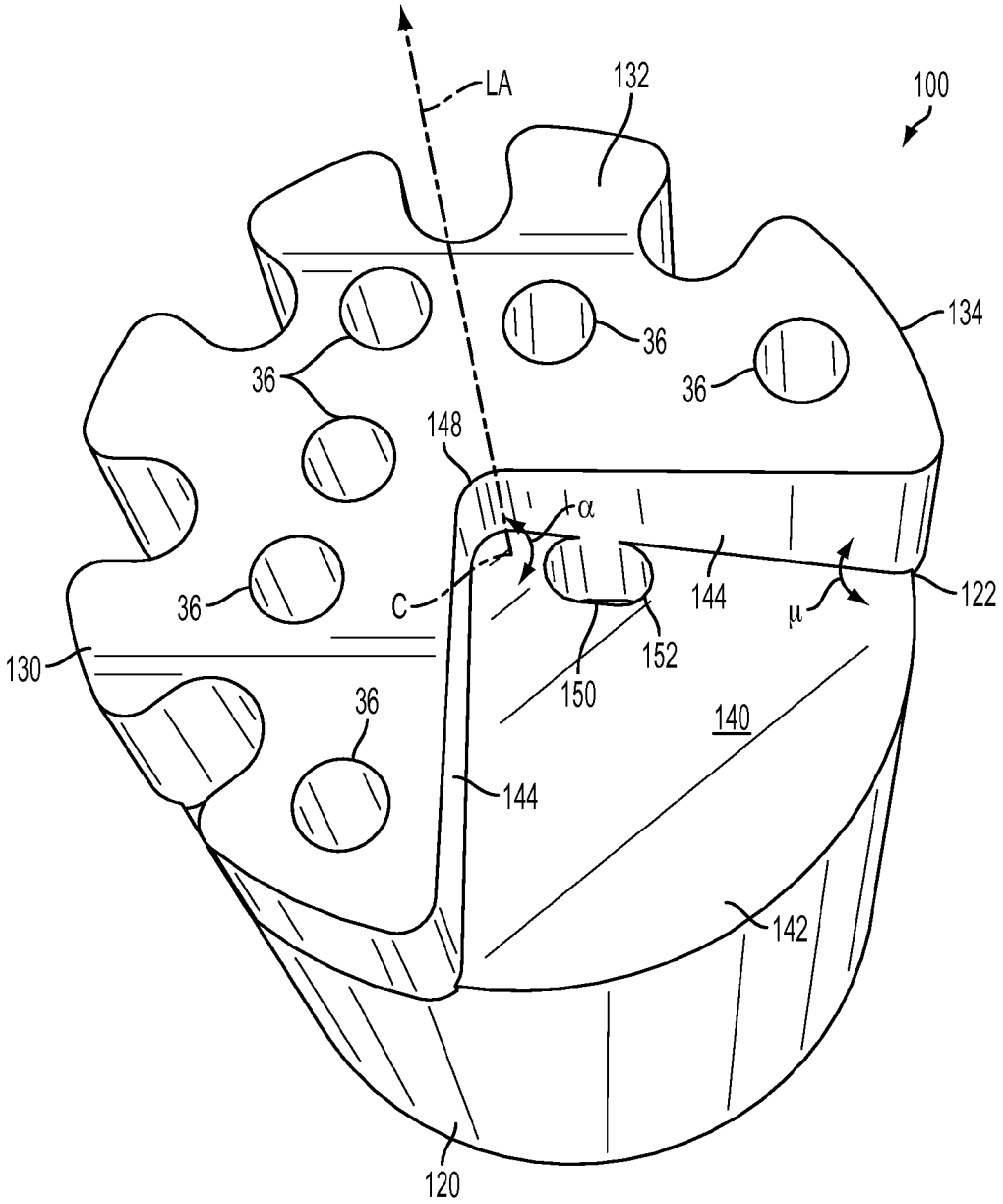
FIG. 2A is a top perspective view of a second embodiment of an exemplary drill bit as disclosed herein.
Figure 2B:
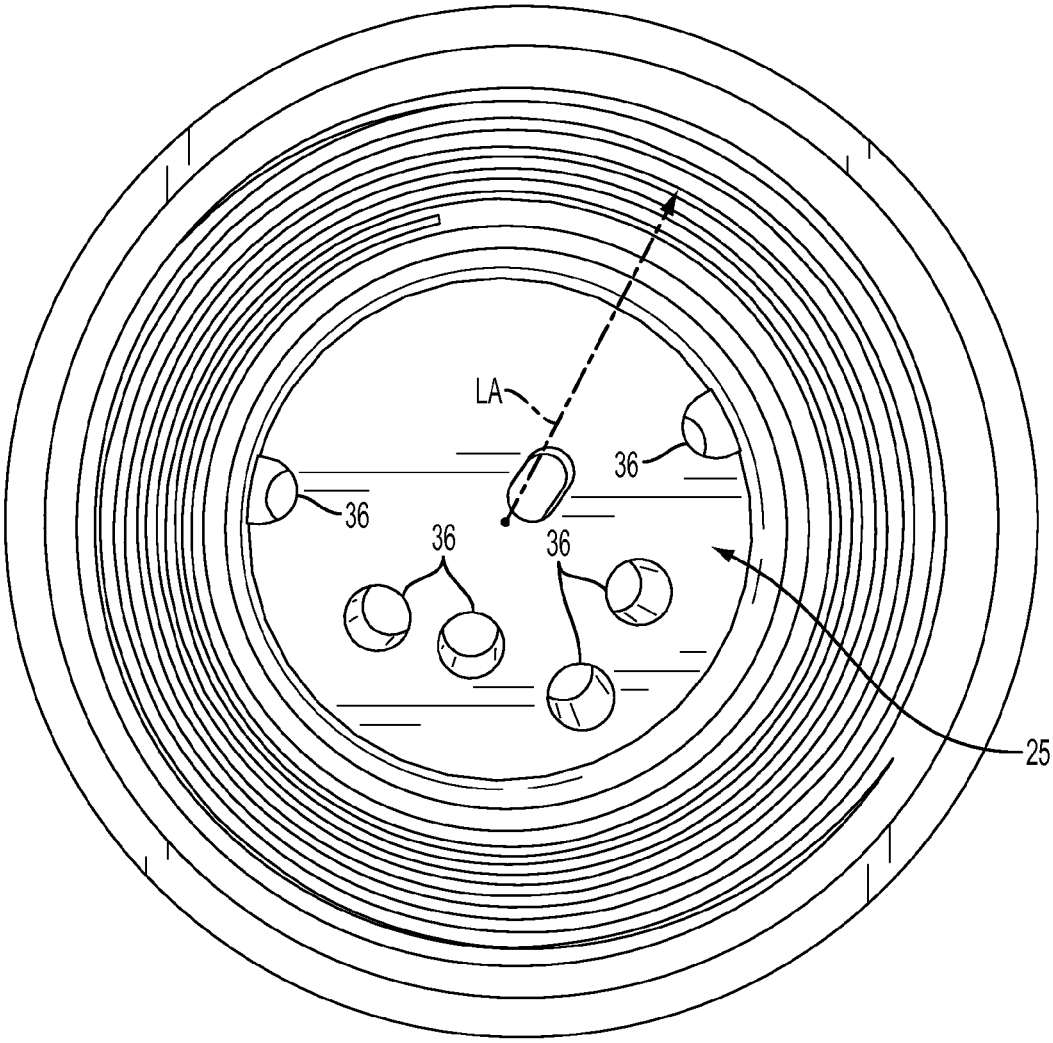
FIG. 2B is a bottom perspective view of the drill bit of FIG. 2A.

In one aspect, the full face crown 30 can have a cutting face 32 that adjoins an outer circumferential surface 34. It is contemplated that the full face crown 30 and the shank 20 can cooperate to define an interior space 25 (such as shown in FIG. 2B) about the longitudinal axis LA. It is further contemplated that the interior space 25 can be configured to receive water or other drilling fluid during use of the drill bit 10. In one aspect, the water or other drilling fluid can be supplied to the interior space 25 at a desired pressure.

In another aspect, the full face crown 30 can define a plurality of bores 36 extending from the cutting face 32 to the interior space 25. In this aspect, it is contemplated that the plurality of bores 36 can be configured to direct water (or other drilling fluid) substantially directly to the cutting face 32 from the interior space 25. It is further contemplated that the direct supply of pressurized water (or other drilling fluid) to the cutting face 32 can increase flow velocity across the cutting face, thereby permitting more rapid removal of cuttings and significantly increasing the convective cooling of the cutting face. It is further contemplated that the plurality of bores 36 can reduce the contact area of the cutting face 32 relative to conventional drill bits, thereby improving the penetration rate of the drill bit 10. It is still further contemplated that the plurality of bores 36 can permit novel distribution of water (or other drilling fluid) relative to the cutting face 32, thereby improving the wear resistance of the drill bit 10. It is still further contemplated that the plurality of bores 36 can provide flexibility in the distribution of water (or other drilling fluid) such that the center port of conventional drill bits is unnecessary (and can be eliminated from the drill bit). Optionally, in some aspects, it is contemplated that the cutting face 32 can have a convex profile (See FIG. 6). In other aspects, it is contemplated that the cutting face 32 can optionally have a concave profile.

In exemplary aspects, the plurality of bores 36 can optionally be substantially equally distributed about the cutting face 32. Optionally, in some aspects, the plurality of bores 36 can be randomly spaced from a center point of the drill bit 10. In other aspects, the plurality of bores can optionally be substantially uniformly spaced from the center point of the drill bit 10. In these aspects, it is contemplated that at least two concentric rows of bores can be provided, with the bores in each respective row being substantially uniformly spaced from the center point of the drill bit 10.

More generally, it is contemplated that the plurality of bores 36 can be provided in any selected configuration. It is further contemplated that the plurality of bores 36 can be distributed so as to optimize the wear characteristics of the drill bit 10 for a particular application.

It is contemplated that the each bore 36 of the plurality of bores can be provided in a selected shape. In exemplary aspects, the plurality of bores 36 can have a substantially cylindrical shape (with substantially circular cross-sectional profile). However, it is contemplated that the plurality of bores 36 can have any shape, including, for example and without limitation, a substantially conical (tapered) shape (with a substantially circular cross-sectional profile), a shape having a substantially rectangular cross-sectional profile, a shape having a substantially square cross-sectional profile, an S-shape, and the like.

In still another aspect, the full face crown 30 can completely circumferentially enclose the interior space 25. In exemplary aspects, the full face crown 30 does not comprise a waterway extending radially between the outer surface 34 of the full face crown and the interior space 25.

In a further aspect, the outer surface of the full face crown 30 can define a plurality of channels 38 extending radially inwardly toward the longitudinal axis LA. In exemplary aspects, it is contemplated that the full face crown 30 can have an outer diameter that is greater than an outer diameter of the shank 20 such that the full face crown projects radially outwardly relative to the shank. Thus, in these aspects, it is further contemplated that the plurality of channels 38 can expose and be in communication with a junction surface 22 of the shank. It is further contemplated that the junction surface 22 can optionally comprise at least one bore 24 positioned in communication with at least one of the plurality of channels 38 of the full face crown 30. It is still further contemplated that the at least one bore 24 of the junction surface 22 of the shank 20 can be in communication with the interior space 25.

Optionally, in exemplary aspects, the plurality of channels 38 can be substantially equally circumferentially spaced about the outer surface 34 of the full face crown 30. In one aspect, it is contemplated that the plurality of channels 38 can optionally be substantially equally sized.

Optionally, in other exemplary aspects, it is contemplated that at least one pair of bores of the plurality of bores 36 can be substantially aligned with a selected channel 38 of the full face crown 30 along an orientation line passing through center points of the bores and the selected channel. In these aspects, it is contemplated that, during drilling operations, as the drill bit 10 rotates, water (or other drilling fluid) that exits the pair of bores can move substantially along the orientation line and be evacuated through the selected channel.

Optionally, in some exemplary aspects, the plurality of channels 38 can comprise a first plurality of channels 38*a* and a second plurality of channels 38*b*, with each channel of the first plurality of channels having a first size and a second plurality of channels having a second size. As used herein, the "size" of a channel 38 generally refers to the two-dimensional area of the channel, as measured within a plane that is substantially perpendicular to the longitudinal axis of the drill bit 10. In these aspects, it is contemplated that the second size can be larger than the first size. In additional exemplary aspects, at least one channel of the first plurality of channels 38*a* can optionally be positioned circumferentially between sequential channels of the second plurality of channels 38*b*. In further exemplary aspects, each channel of the first plurality of channels 38*a* can have a first radial length, and each channel of the second plurality of channels 38*b* can have a second radial length. In these aspects, it is contemplated that the second radial length can optionally be greater than the first radial length.

In further optional aspects, it is contemplated that the plurality of channels 38 can further comprise a third plurality of channels 38*c*, with each channel of the third plurality of channels having a third size that is different than the first and second sizes (of the first plurality of channels and the second plurality of channels). As shown in FIG. 1, it is contemplated that the third size can be smaller than the first and second sizes. However, it is contemplated that, in exemplar aspects, the third size can also be larger than the first and second sizes. In additional exemplary aspects, it is contemplated that at least one channel of the third plurality of channels 38*c* can optionally be positioned circumferentially between a respective channel of the first plurality of channels 38*a* and a respective channel of the second plurality of channels 38*b*. In further exemplary aspects, each channel of the third plurality of channels 38*c* can have a third radial length. In these aspects, it is contemplated that the third radial length can optionally be less than the first and second radial lengths (of the first plurality of channels and the second plurality of channels). However, in other aspects, it is contemplated that the third radial length can optionally be greater than at least one of the first and second radial lengths.

More generally, it is contemplated that the plurality of channels 38 can comprise channels having any number of different sizes, such as, for example and without limitation, channels of at least four different sizes, channels of at least five different sizes, channels of at least six different sizes, channels of at least seven different sizes, and channels of at least eight different sizes. In exemplary aspects, it is contemplated that each channel of the plurality of channels 38 can have a size that differs from a size of at least one additional channel of the plurality of channels.

In additional aspects, each channel of the plurality of channels 38 can have a width. Optionally, in these aspects, it is contemplated that each channel of the plurality of channels 38 can have a variable width. For example, the width of each channel 38 can optionally decrease from the outer surface of the full face crown moving radially inwardly toward the longitudinal axis. Thus, it is contemplated that each channel 38 of the plurality of channels can be inwardly tapered moving toward the longitudinal axis LA.

Optionally, as shown in FIG. 1, it is contemplated that the radius of the shank 20 (corresponding to the radial distance between the longitudinal axis LA and an outer surface of the shank) can vary about the circumference of the shank. In exemplary aspects, it is contemplated that the outer surface of the shank 20 can be recessed a selected distance from the outer surface 34 of the full face crown 30 within each respective channel 38. In these aspects, it is contemplated that the selected distance by which the outer surface of the shank 20 is recessed from the outer surface 34 of the full face crown 30 can vary from channel to channel. For example, as shown in FIG. 1, it is contemplated that the selected distance by which the outer surface of the shank 20 is recessed from the outer surface 34 of the full face crown 30 can generally be greater for smaller channels (38*c*) than it is for larger channels (38*a*, 38*b*). However, it is contemplated that any variation in the selected distance (and the radius of the shank 20) can be employed.

Optionally, in further exemplary aspects, it is contemplated that an inner surface of the shank 20 can define at least one flute (or extending substantially parallel to the longitudinal axis LA of the bit 10. In these aspects, each flute of the at least one flute can optionally correspond to a rounded grooves extending radially from the inner surface of the shank 20 toward an outer surface of the shank. It is contemplated that the at least one flute can optionally be positioned in fluid communication with at least one of a bore 36 of the full face crown 30 and a bore 24 of the shank 20.

Referring now to FIGS. 2A-7, an exemplary drill bit 100 is shown that is configured to channel and fracture a micro-core from the center of the drill bit and direct and/or flush the fractured micro-core to the outer diameter of the drill bit. Complementarily, this exemplary configuration allows for reduced wear of the inner diameter of the drill bit, which is the typical wear mode of conventional full face bits. Further, the exemplary full face drill bit increases the rate of penetration in comparison to conventional full face bits that, due to their intrinsic design limitations, have a limited ability to cut at the center of the full face bit as a result of the very low surface velocities. As one will appreciate, it is contemplated that the drill bit 100 can also comprise the elements described above with respect to drill bit 10. Similarly, it is contemplated that the drill bit 10 can comprise one or more of the elements described below with respect to drill bit 100.

On skilled in the art will appreciate that conventional full face bits typically wear from the center of the upper contact face of the drill bit as a result of low cutting velocity and poor chip flushing. This design failure mode is exacerbated as the rock being drilled increases in hardness. The cycle of wear in the center of a full face bit leading the further reduced flushing in the center, which in-turn causes more wear, drastically limits the potential life of full face bits when compared to coring bits. In the past, bit designs have attempted to overcome this design failure mode by adding one or more of a center port and/or waterways that are distributed on the bit or by reinforcing the center port waterway to reduce the wear rate at the center of the bit.

In one aspect, the drill bit 100 has a longitudinal axis. In exemplary aspects, the drill bit 100 can comprise a shank 120 and a full face crown 130 that extends along the longitudinal axis. In one aspect, the full face crown has a crown outer diameter and the shank has a shank outer diameter that is less than the outer diameter of the full face crown. Further, it is contemplated that the shank can further define a tapered surface 122 that extends distally from the shank outer diameter to the crown outer diameter. In various aspects, it is contemplated that the tapered surface 122 can be angled with respect to the longitudinal axis at an obtuse angle ρ. For example, the angle ρ can be between about 90.5° and about 150°, and preferably between about 120° and about 140°.

Figure 6:
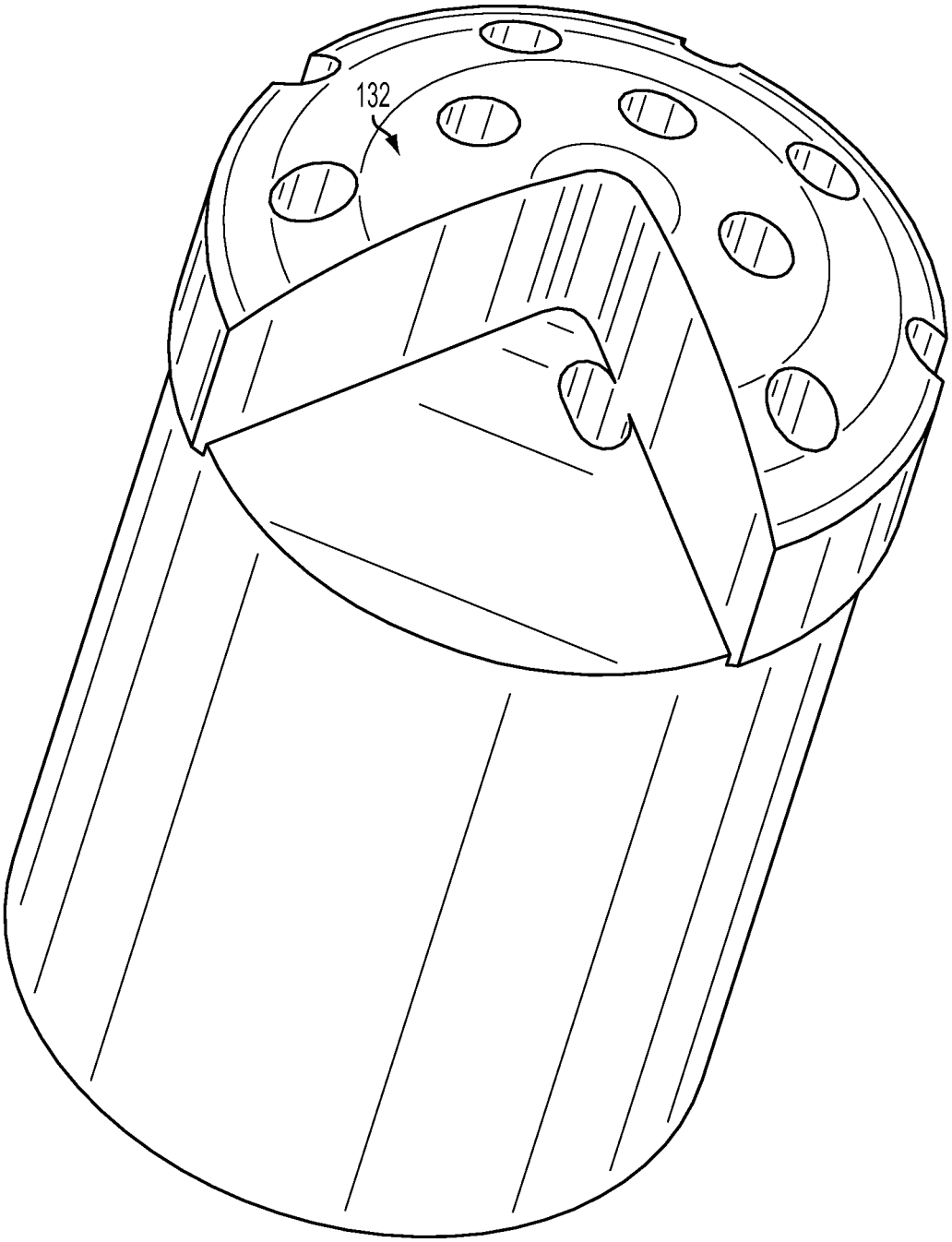
FIG. 6 is a perspective view of an exemplary drill bit having a convex cutting face as disclosed herein.

In a further aspect, the full face crown 130 can define a slot 140 that extends longitudinally therein a portion of the cutting face 132 and the circumferential outer surface 134 of the full face crown. It is contemplated that this slot can be configured to allow for the fracture and ejection of desired core samples. In an exemplary aspect, a conduit 150 can be defined in the drill bit that is in communication with the interior space 25 and the pressurized drilling fluid can be positioned in communication with a portion of the defined slot such that a desired amount of drilling fluid can be delivered into the slot during a drilling operation. Optionally, in some aspects and as shown in FIG. 6, it is contemplated that the cutting face 132 can have a convex profile. In other aspects, it is contemplated that the cutting face 132 can optionally have a concave profile.

In one exemplary aspect, the slot 140 has a bottom surface 142 and a pair of two opposing side walls 144 that are positioned relative to each other at a desired angle β. In one exemplary aspect, the slot is shaped such that the two side walls are positioned substantially parallel to each other such that the angle β is approximately 0°. Optionally, the slot can have a wedge like shape such that the angle β can exemplarily be between about 0° and about 140°, preferably between about 30° and about 110°, preferably between about 55° and about 95°, and most preferred below about 90°.

In a further aspect, the bottom surface 142 of the slot can be positioned at an angle μ with respect to the adjoining side wall 144. For example, the angle μ can be between about 60° and about 120°, preferably between about 85° and about 110°, and most preferred about 90°. In yet another aspect, the bottom surface 142 of the slot can be angled with respect to the longitudinal axis of the drill bit at a desired angle α. In one exemplary aspect, it is preferred that the bottom surface 142 of the slot be angled proximally to encourage the dispersal of fractured material proximally away from the cutting face 132 of the drill bit. For example, the angle α can be between about 90° and 140°, and preferably between about 90° and about 130°, and about 150°, and most preferred greater than or equal to about 90°.

In optional contemplated aspects, at least a portion of the bottom surface 142 and the side walls 144 of the slot can be substantially planar; at least one of the bottom surface 142 and the side walls 144 of the slot can be substantially planar; at least a portion of one of the bottom surface 142 and the side walls 144 of the slot can be curved (either distally or proximally for the bottom surface 142 or outwardly for the side walls 144 of the slot; and at least one of the bottom surface 142 and the side walls 144 of the slot can be curved (either distally or proximally for the bottom surface or outwardly for the side walls of the slot.

The slot 140 further defines an apex 148 that is positioned beyond the center of the cutting face of the drill bit. As one skilled in the art will appreciate, the slot thusly is configured such that the longitudinal axis of the drill bit extends through the bottom surface of the slot and into an interior void area of the slot. In a further aspect, an over-center area is defined on the cutting face of the bit by the position of the apex relative to the defined center C of the cutting face, e.g., the point of the cutting face bisected by the longitudinal axis. As exemplarily shown in FIG. 4, the over-center area is the area on the cutting face that extends from the junction of the base of the side walls 144 and the bottom surface 142 to two imaginary lines that extend through the center C of the cutting face and are parallel to the respective side walls 144. For example, the over-center area, as a percentage of the area of the cutting face, can be between about 5% and about 45%, and preferably between about 10% and about 40%, and about 15% and about 30%, and most preferred about 20%.

In an exemplary aspect, it is contemplated that a distal end 152 of the conduit 150 is formed in at least a portion of the bottom surface of the slot. Further, it is contemplated that a distal end 152 can be formed in a portion of one side wall 144 of the slot. In another exemplary embodiment, the distal end 152 of the conduit 150 can be positioned such that a portion of the conduit 150 is positioned at a juncture of a portion of the bottom surface and a portion of an adjoining side wall of the slot. Optionally, it is contemplated that at least a portion of the distal end 152 of the conduit can be defined in at least a portion of the defined over-center area. In another aspect, a majority of the distal end 152 of the conduit can be defined in a portion of the defined over-center area.

Figure 7:
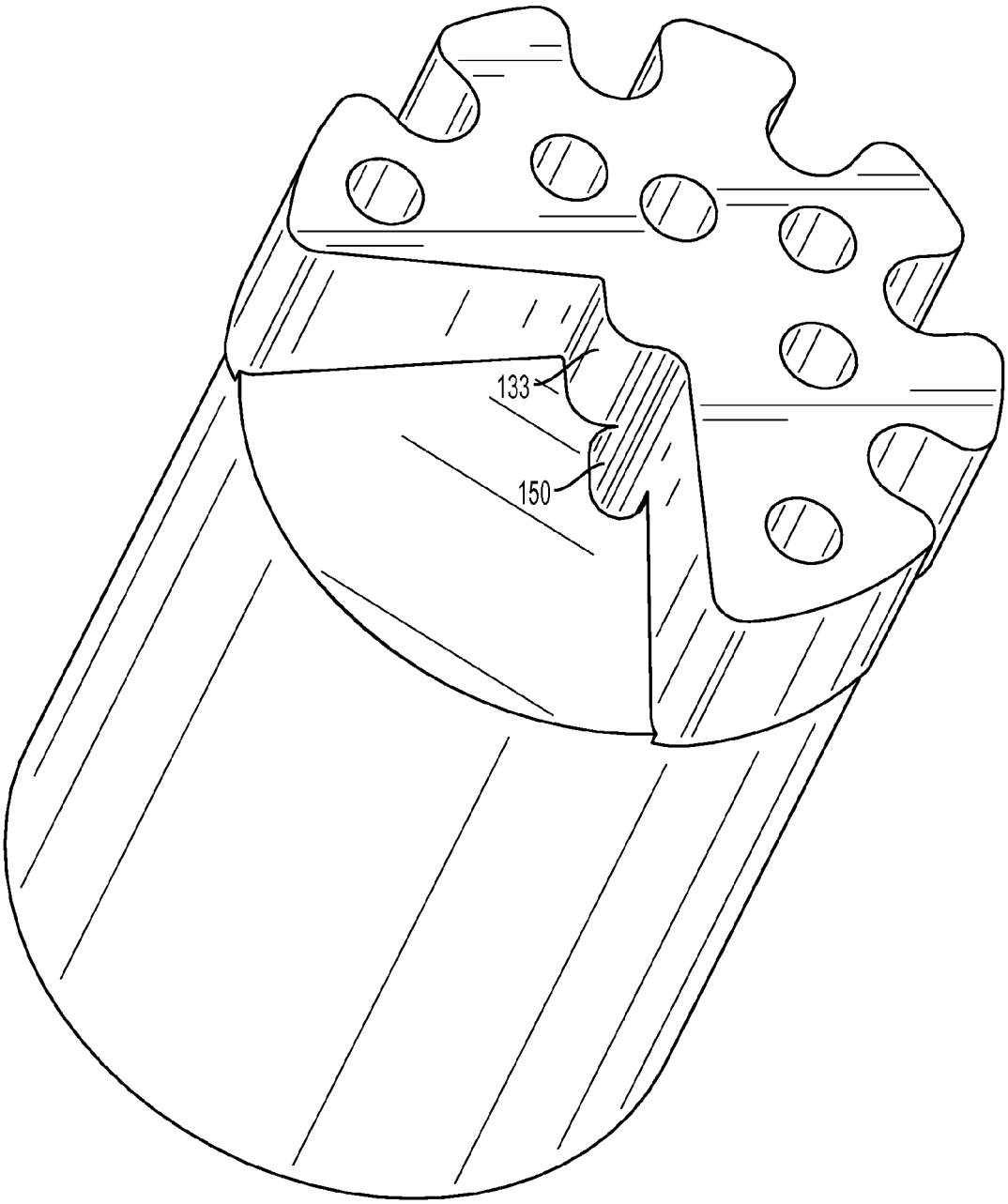
FIG. 7 is a top perspective view of an exemplary drill bit having a center projection extending into a slot as disclosed herein.

In other optional aspects, and as depicted in FIG. 7, it is contemplated that the full face crown 130 can comprise a central projection 133 that extends across the center C of the cutting face into the slot 140. In these aspects, it is contemplated that the projection 133 can cooperate with the side walls 144 to define the slot 140. It is further contemplated that a top portion of the central projection 133 of the crown 130 can comprise a matrix material that is configured to wear away (due to at least one of erosion and abrasion) such that, over time, after the central projection 133 is worn down, the profile of the slot 140 corresponds to the exemplary profile disclosed above (defined by surface 142 and the side walls 144, which comprise diamond-infiltrated material as further disclosed herein. In exemplary aspects, the projection 133 can have an arcuate profile, thereby effectively eliminating the apex 148 of the slot 140 (until the projection 133 is worn away).

In exemplary aspects, when the drill bit 100 comprises both the slot 140 and a plurality of bores 36 (as disclosed with respect to drill bit 10), it is contemplated that the slot can allow core to substantially freely flow from the cutting face to the outer diameter of the crown. It is further contemplated that the non-uniform crown can create an off-balance motion, thereby permitting easier breaking of the core.

Figure 8:
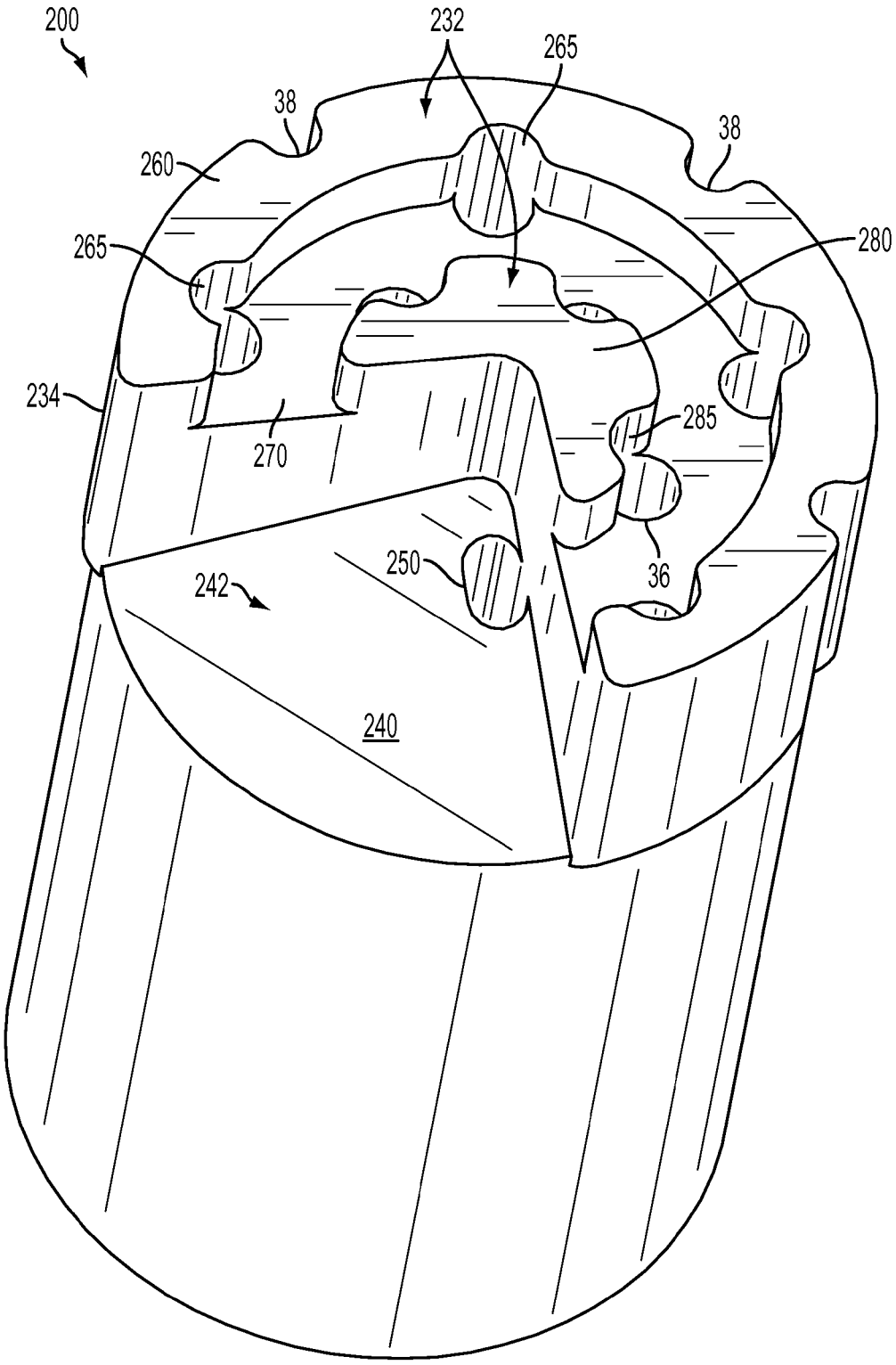
FIG. 8 is a top perspective view of a third embodiment of an exemplary drill bit as disclosed herein.

Referring now to FIG. 8, an exemplary drill bit 200 is shown that is configured to channel and fracture a micro-core from the center of the drill bit and direct and/or flush the fractured micro-core to the outer diameter of the drill bit. Complementarily, this exemplary configuration allows for reduced wear of the inner diameter of the drill bit, which is the typical wear mode of conventional full face bits. Further, the exemplary full face drill bit increases the rate of penetration by decreasing the required force output in comparison to conventional full face bits that, due to their intrinsic design limitations, have a limited ability to cut at the center of the full face bit as a result of the very low surface velocities. As one will appreciate, it is contemplated that the drill bit 200 can also comprise the elements described above with respect to drill bits 10 and 100. Similarly, it is contemplated that the drill bits 10 and 100 can comprise one or more of the elements described below with respect to drill bit 200.

In one aspect, the drill bit 200 can have a full face crown 230 and can define a slot 240 that extends longitudinally therein a portion of a cutting face 232 and the circumferential outer surface 234 of the full face crown. It is contemplated that this slot can be configured to allow for the fracture and ejection of desired core samples. In an exemplary aspect, a conduit 250 can be defined in the bottom surface 142 of the slot 140 of the drill bit and is in communication with the interior space 25 and the pressurized drilling fluid can be positioned in communication with a portion of the defined slot such that a desired amount of drilling fluid can be delivered into the slot during a drilling operation. As shown in FIG. 8, it is further contemplated that the drill bit 200 can comprise bores 36 and channels 38 as disclosed above with respect to drill bits 10, 100.

In exemplary aspects, as shown in FIG. 8, the drill bit 200 can have an axially recessed portion 270 positioned radially between first and second cutting portions 260, 280. In these aspects, it is contemplated that the first and second cutting portions can each define a portion of the cutting surface 232, with the recessed portion 270 being recessed relative to the cutting surface. Thus, it is contemplated that the cutting face 232 can be stepped up in the highest-wear areas of the cutting face.

Optionally, it is contemplated that an interior wall 265 of the first cutting portion 260 can define at least one channel 265, as shown in FIG. 8. It is contemplated that each channel 265 can optionally be positioned in fluid communication with a respective bore 36 of the drill bit 200.

In additional aspects, it is contemplated that the second cutting portion 280 can be substantially centrally positioned relative to the cutting face 232 such that the second cutting portion cooperates with side walls of the slot to define the apex of the slot (where no central projection is present) or, alternatively, the second cutting portion cooperates with side walls of the slot to define the central projection (when present). In further aspects, it is contemplated that the second cutting portion 280 can optionally define at least one channel 285, as shown in FIG. 8. In these aspects, it is further contemplated that each channel 285 can optionally be positioned in fluid communication with a respective bore 36 of the drill bit 200.

In exemplary aspects, the drill bits 10, 100, 200 disclosed herein can be diamond-impregnated bits, with the diamonds impregnated within a matrix. In these aspects, it is contemplated that each drill bit 10, 100, 200 can comprise a plurality of selected materials, with each material being provided as a selected weight percentage of the drill bit. It is contemplated that each drill bit 10, 100, 200 can comprise carbon (not including diamond) in any desired amount, such as, for example and without limitation, an amount ranging from about 0.00% to about 7.00% by weight of the drill bit. In exemplary aspects, the carbon of the drill bits 10, 100, 200 can be provided as at least one of carbon powder and carbon fibers. It is further contemplated that each drill bit 10, 100, 200 can comprise chromium in any desired amount, such as, for example and without limitation, an amount ranging from about 0.00% to about 1.00% by weight of the drill bit. It is further contemplated that each drill bit 10, 100, 200 can comprise cobalt in any desired amount, such as, for example and without limitation, an amount ranging from about 0.00% to about 1.00% by weight of the drill bit. Optionally, it is further contemplated that each drill bit 10, 100, 200 can comprise copper in an any desired amount, such as, for example and without limitation, an amount ranging from about 0.00% to about 30.00% by weight of the drill bit. It is further contemplated that each drill bit 10, 100, 200 can comprise iron in any desired amount, such as, for example and without limitation, an amount ranging from about 50.00% to about 90.00% by weight of the drill bit. It is further contemplated that each drill bit 10, 100, 200 can comprise manganese in any desired amount, such as, for example and without limitation, an amount ranging from about 0.00% to about 8.00% by weight of the drill bit. It is further contemplated that each drill bit 10, 100, 200 can comprise molybdenum in any desired amount, such as, for example and without limitation, an amount ranging from about 0.00% to about 0.20% by weight of the drill bit. It is further contemplated that each drill bit 10, 100, 200 can comprise nickel in any desired amount, such as, for example and without limitation, an amount ranging from about 0.00% to about 6.00% by weight of the drill bit. It is further contemplated that each drill bit 10, 100, 200 can comprise silicon in any desired amount, such as, for example and without limitation, an amount ranging from about 0.00% to about 0.50% by weight of the drill bit. It is further contemplated that each drill bit 10, 100, 200 can comprise silicon carbide in any desired amount, such as, for example and without limitation, an amount ranging from about 0.00% to about 2.00% by weight of the drill bit. It is further contemplated that each drill bit 10, 100, 200 can comprise silver in any desired amount, such as, for example and without limitation, an amount ranging from about 0.00% to about 12.00% by weight of the drill bit. It is further contemplated that each drill bit 10, 100, 200 can comprise tin in any desired amount, such as, for example and without limitation, an amount ranging from about 0.00% to about 6.00% by weight of the drill bit. It is further contemplated that each drill bit 10, 100, 200 can comprise tungsten in any desired amount, such as, for example and without limitation, an amount ranging from about 0.00% to about 41.00% by weight of the drill bit. It is further contemplated that each drill bit 10, 100, 200 can comprise tungsten carbide in any desired amount, such as, for example and without limitation, an amount ranging from about 0.00% to about 35.00% by weight of the drill bit. It is further contemplated that each drill bit 10, 100, 200 can comprise zinc in any desired amount, such as, for example and without limitation, an amount ranging from about 0.00% to about 24.00% by weight of the drill bit. It is further contemplated that the matrix of the full face drill bits disclosed herein can be configured to form supporting structures behind the diamonds within the drill bits, thereby preventing the polishing of the impregnated diamonds during operation.

In exemplary aspects, and with reference to FIG. 9, the drill bits disclosed herein can further optionally comprise a plurality of wear-resistant members 160 that are embedded therein portions of at least one of the bottom surface 142 and/or the side surface(s) 144 of the drill bit. It is contemplated, optionally and without limitation, that the plurality of wear-resistant members 160 can be embedded therein portions of the bottom surface 142 adjacent to the side wall of the slot that serves as the impact wall (e.g., the trailing wall) as a result of the rotation of the drill bit in use. In this aspect, it is contemplated that the plurality of wear-resistant members 160 can be embedded in an area of the bottom surface 142 proximate to the juncture of the bottom surface and the respective side wall. In a further aspect, the plurality of wear-resistant members 160 in the bottom surface can be positioned in a desired, predetermined array. In one example, the array of the plurality of wear-resistant members 160 can comprise a series of rows of wear-resistant members. In this aspect, it is contemplated that each row can comprise a plurality of the wear-resistant members 160 positioned substantially along a common axis. Optionally, the common axis can be substantially parallel to the adjacent side wall. Thus, it is contemplated that the array of the plurality of wear-resistant members 160 can comprise a series of rows of wear-resistant members in which each of the rows are substantially parallel to each other and to the adjacent side wall.

In a further aspect, optionally and without limitation, that the plurality of wear-resistant members 160 can be embedded therein portions of the side wall 144 that serves as the impact wall (e.g., the trailing wall) as a result of the rotation of the drill bit in use. In this aspect, it is contemplated that the plurality of wear-resistant members 160 can be embedded in an area of the side wall 144 proximate to the juncture of the bottom surface and the side wall. In a further aspect, the plurality of wear-resistant members 160 in the bottom surface can be positioned in a desired, predetermined array. In one example, the array of the plurality of wear-resistant members 160 can comprise a series of rows of wear-resistant members. In this aspect, it is contemplated that each row can comprise a plurality of the wear-resistant members 160 positioned substantially along a common axis. Optionally, the common axis can be substantially parallel to the adjacent bottom surface. Thus, it is contemplated that the array of the plurality of wear-resistant members 160 can comprise a series of rows of wear-resistant members in which each of the rows are substantially parallel to each other and to the adjacent bottom surface. In a further aspect, the array of the plurality of wear-resistant members 160 positioned on the side wall can be spaced away from the cutting face of the drill bit at a desired distance.

In another aspect, at least a portion of the plurality of wear resistant members 160 can extend proudly from the respective bottom surface 142 and/or side wall 144 in which it is embedded. In one aspect, it is further contemplated that the array can comprise additional rows of wear resistant members that are encapsulated within the drill bit in an underlying relationship with the exposed rows of the wear-resistant members that are positioned in one of the bottom surface 142 and/or the side surface(s) of the 144 of the drill bit. In this fashion, the additional wear-resistant members can be exposed upon the normal wear of the drill bit during operation.

In one aspect, each wear-resistant member 160 can be an elongated member, for example and without limitation, the elongate member can have a generally rectangular shape having a longitudinal axis. As shown in FIG. 9, it is contemplated that the elongate members 160 can be positioned such that the longitudinal axis of each elongate member is substantially parallel to the adjacent bottom surface and/or side wall. Without limitation, it is contemplated that each wear-resistant member 160 can comprise at least one of Tungsten Carbide, TSD (thermally stable diamond), PDC (polycrystalline diamond compact), CBN (cubic boron nitride), single crystal Aluminum Oxide, Silicon Carbide, wear resistant ceramic materials, synthetic diamond materials, natural diamond, and polycrystalline diamond materials.

In exemplary aspects, and with reference to FIG. 10, the drill bits disclosed herein can be provided as part of a drilling system 500. In these aspects, it is contemplated that the drilling system 500 can comprise a drill head 510, a mast 520, a drill rig 530, and a drill string 550 configured to be secured to and rotated by the drill rig, as are conventionally known in the art. It is further contemplated that a drill bit 560 can be operatively coupled to an end of the drill string 550. For example, it is contemplated that a drill bit 10, 100, 200 as disclosed herein can be coupled to the drill string 550. In operation, as the drill string 550 is rotated and pushed by the drill rig 530, it is contemplated that the drill bit 560 (corresponding to a drill bit 10, 100, 200 as disclosed herein) can grind away materials in a formation 570.

In use, it is contemplated that the full face drill bits disclosed herein can achieve desired penetration levels at lower levels of thrust than are required with known drill bits. Due to the increased strength and flushing of the full face drill bits disclosed herein, it is contemplated that the disclosed full face drill bits can show less wear and have an increased functional product life compared to known drill bits, with the full face drill bits disclosed herein having a functional product life of up to about 5 times greater than the functional product life of known bits. It is further contemplated that the increased strength and flushing of the disclosed full face drill bits can permit the use of greater depths for diamond impregnation during manufacturing. It is still further contemplated that the disclosed full face drill bits can produce higher fluid velocity at the cutting face, thereby providing faster rock removal and heat transfer and limiting wear of the diamonds within the bit, which are typically worn due to the high heat and friction of the rock.

EXPERIMENTAL EXAMPLES

In one experimental example, a 0.250 inch-diameter core was removed using an exemplary drill bit as depicted in FIGS. 2A-4. In another experimental example, the exemplary drill bit showed little wear after drilling 12 inches, whereas a known drill bit was substantially worn after drilling 12 inches.

Figure 3:
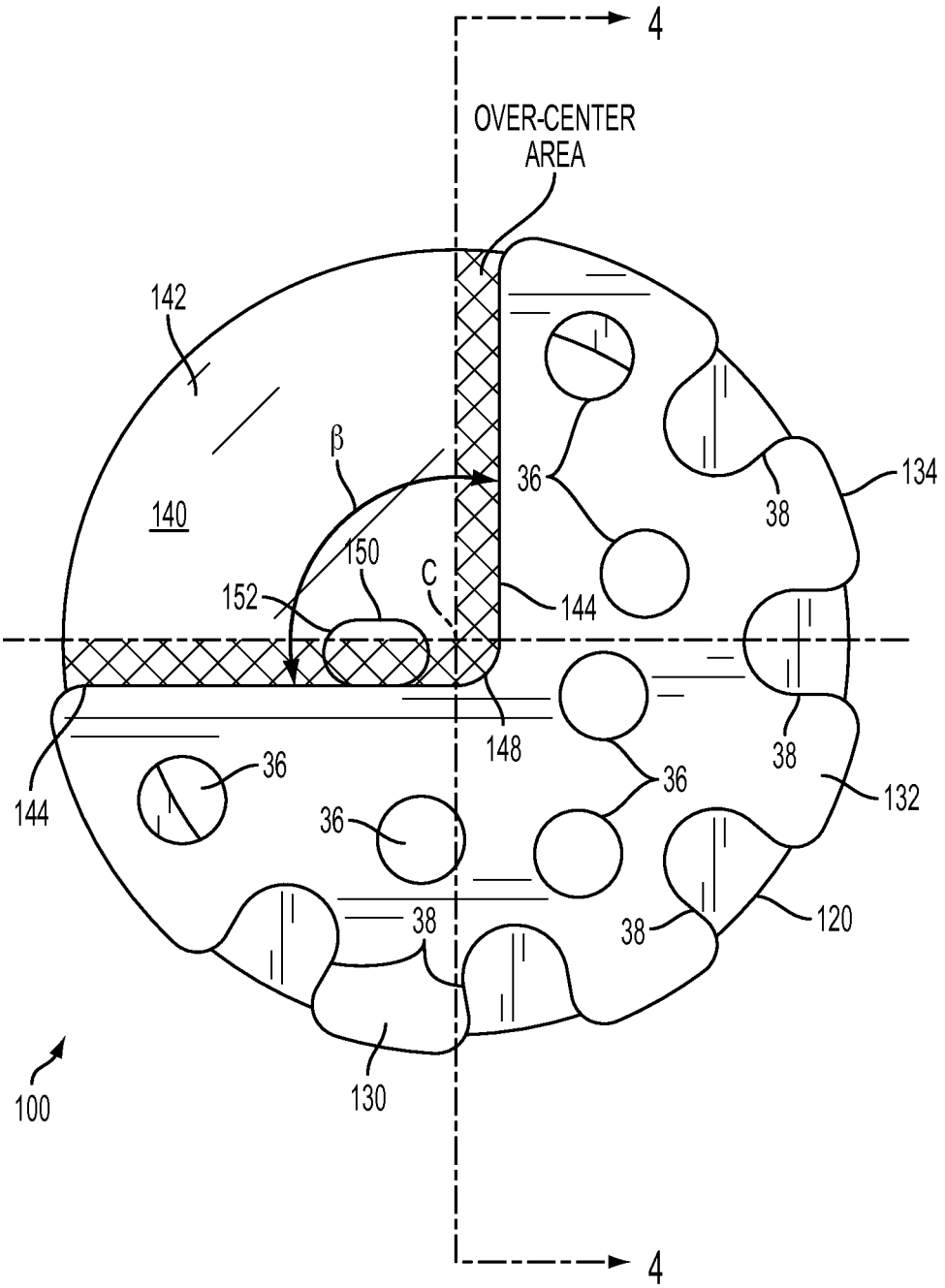
FIG. 3 is a top plan of the drill bit of FIG. 2A as disclosed herein.
Figure 4:
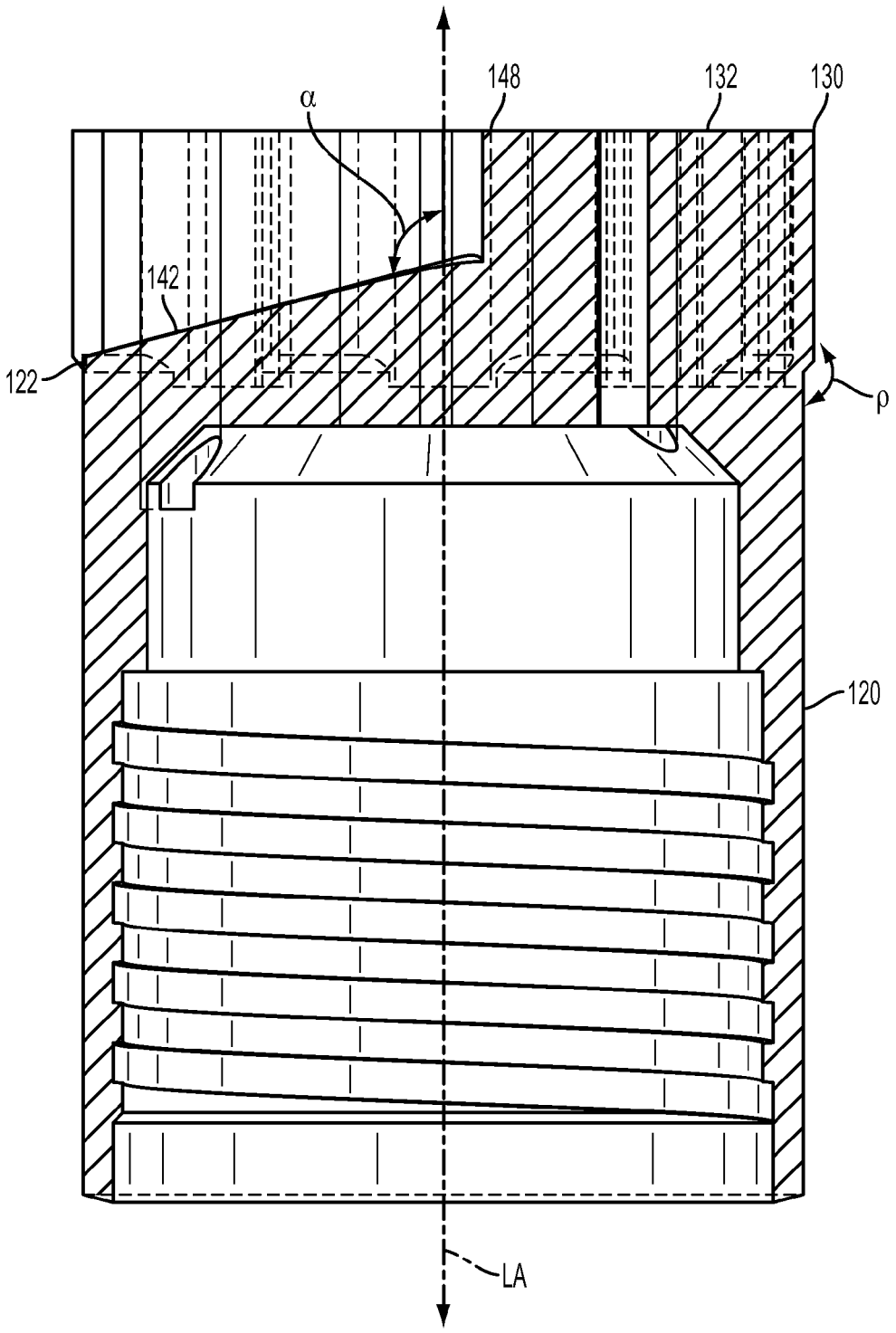
FIG. 4 is a cross-sectional view of the drill bit of FIG. 3 taken along line 4-4 as disclosed herein.
Figure 5:
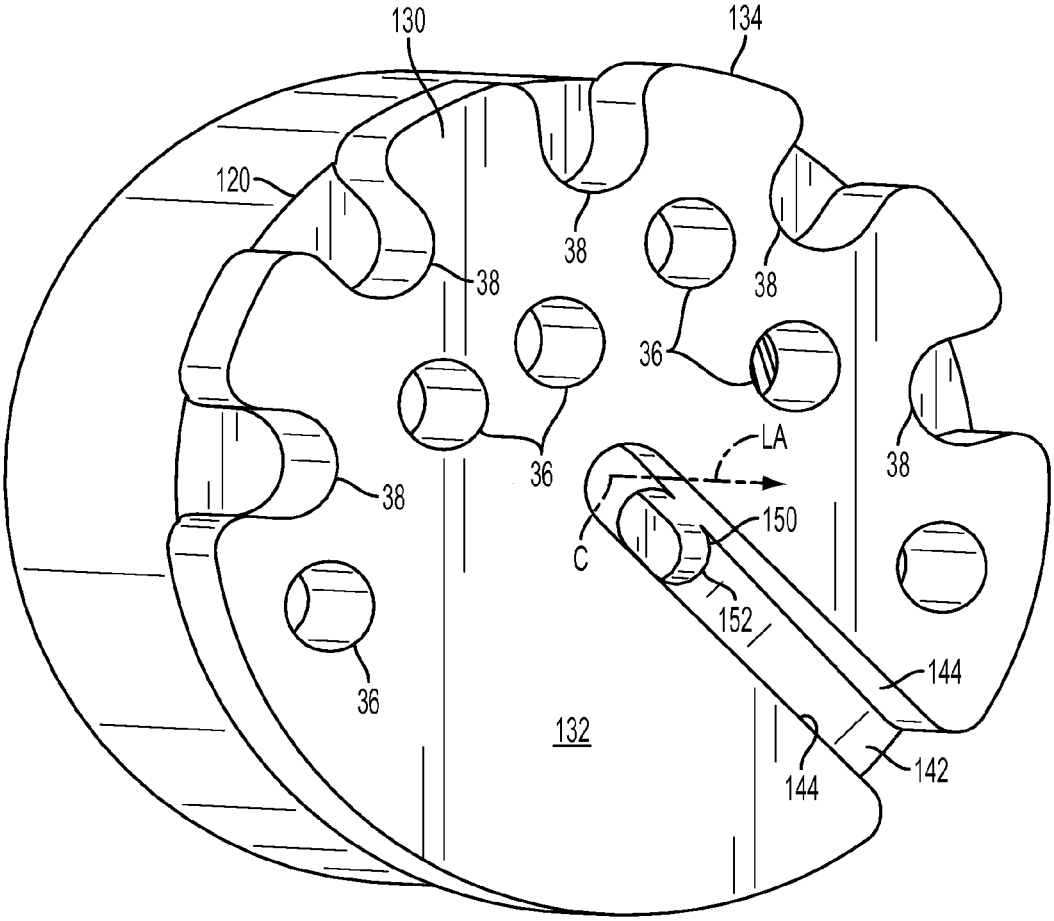
FIG. 5 is a top perspective view of a second embodiment of an exemplary drill bit as disclosed herein.

In additional experimental examples, a computational fluid dynamics (CFD) comparison was performed between an exemplary full face drill bit as depicted in FIGS. 3-5 and a known full face drill bit. The exemplary drill bit as disclosed herein was found to produce a higher water pressure and higher fluid velocity.

EXEMPLARY ASPECTS

In exemplary aspects, a full-face drill bit for forming a hole in a formation is a provided, the drill bit having a longitudinal axis and comprising: a shank; a full face crown having a cutting face and an outer surface, the full face crown and the shank cooperating to define an interior space about the longitudinal axis, wherein the full face crown defines a plurality of bores extending from the cutting face to the interior space, and wherein the full face crown completely circumferentially encloses the interior space.

In one exemplary aspect, the full face crown does not comprise a waterway extending radially between the outer surface of the full face crown and the interior space.

In another exemplary aspect, the outer surface of the full face crown defines a plurality of channels extending radially inwardly toward the longitudinal axis.

In another exemplary aspect, the plurality of channels are substantially equally circumferentially spaced about the outer surface of the full face crown.

In another exemplary aspect, each channel of the plurality of channels has a width, and the width of each channel decreases from the outer surface of the full face crown moving radially inwardly toward the longitudinal axis.

In another exemplary aspect, the plurality of channels are substantially equally sized.

In another exemplary aspect, the plurality of channels comprise a first plurality of channels having a first size and a second plurality of channels having a second size, and the second size is larger than the first size.

In another exemplary aspect, at least one channel of the first plurality of channels is positioned circumferentially between sequential channels of the second plurality of channels.

In another exemplary aspect, each channel of the first plurality of channels has a first radial length, each channel of the second plurality of channels has a second radial length, and the second radial length is greater than the first radial length.

In another exemplary aspect, the plurality of bores are substantially equally distributed about the cutting face.

In other exemplary aspects, a drilling system is provided, the drilling system comprising: a drill rig; a drill string configured to be secured to and rotated by the drill rig; and a full-face drill bit having a longitudinal axis and configured to be secured to the drill string, the drill bit comprising: a shank; a full face crown having a cutting face and an outer surface, the full face crown and the shank cooperating to define an interior space about the longitudinal axis, wherein the full face crown defines a plurality of bores extending from the cutting face to the interior space, and wherein the full face crown of the drill bit completely circumferentially encloses the interior space of the drill bit.

In another exemplary aspect, the full face crown of the drill bit does not comprise a waterway extending radially between the outer surface of the full face crown and the interior space.

In another exemplary aspect, the outer surface of the full face crown defines a plurality of channels extending radially inwardly toward the longitudinal axis.

In another exemplary aspect, the plurality of channels of the drill bit are substantially equally circumferentially spaced about the outer surface of the full face crown.

In another exemplary aspect, each channel of the plurality of channels of the drill bit has a width, and the width of each channel decreases from the outer surface of the full face crown moving radially inwardly toward the longitudinal axis.

In another exemplary aspect, the plurality of channels of the drill bit are substantially equally sized.

In another exemplary aspect, the plurality of channels of the drill bit comprise a first plurality of channels having a first size and a second plurality of channels having a second size, wherein the second size is larger than the first size.

In another exemplary aspect, at least one channel of the first plurality of channels of the drill bit is positioned circumferentially between sequential channels of the second plurality of channels.

In another exemplary aspect, each channel of the first plurality of channels of the drill bit has a first radial length, each channel of the second plurality of channels of the drill bit has a second radial length, and the second radial length is greater than the first radial length.

In another exemplary aspect, the plurality of bores of the drill bit are substantially equally distributed about the cutting face.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A full-face impregnated drill bit for forming a hole in a formation, the drill bit having a longitudinal axis and comprising:

a shank;

a full face crown having a cutting face and an outer surface, the full face crown and the shank cooperating to define an interior space about the longitudinal axis, wherein the cutting face is configured to contact the formation to form the hole, wherein the full face crown defines a plurality of bores extending from the cutting face to the interior space, wherein each bore comprises an outlet portion that is circumferentially surrounded by the cutting face such that the plurality of bores reduce an area of contact between the cutting face and the formation, wherein the plurality of bores are configured to direct drilling fluid directly to the cutting face from the interior space, and wherein the full face crown comprises diamonds impregnated within a matrix, wherein the full face crown completely circumferentially encloses the interior space, and wherein the full face crown does not comprise a waterway extending radially between the outer surface of the full face crown and the interior space.

2. The drill bit of claim 1, wherein the outer surface of the full face crown defines a plurality of channels extending radially inwardly toward the longitudinal axis.

3. The drill bit of claim 2, wherein the plurality of channels are substantially equally circumferentially spaced about the outer surface of the full face crown.

4. The drill bit of claim 2, wherein each channel of the plurality of channels has a width, and wherein the width of each channel decreases from the outer surface of the full face crown moving radially inwardly toward the longitudinal axis.

5. The drill bit of claim 2, wherein the plurality of channels are substantially equally sized.

6. The drill bit of claim 2, wherein the plurality of channels comprise a first plurality of channels having a first size and a second plurality of channels having a second size, wherein the second size is larger than the first size.

7. The drill bit of claim 6, wherein at least one channel of the first plurality of channels is positioned circumferentially between sequential channels of the second plurality of channels.

8. The drill bit of claim 7, wherein each channel of the first plurality of channels has a first radial length, wherein each channel of the second plurality of channels has a second radial length, and wherein the second radial length is greater than the first radial length.

9. The drill bit of claim 2, wherein the plurality of bores are substantially equally distributed about the cutting face.

10. The drill bit of claim 1, wherein the longitudinal axis of the drill bit bisects a center of the cutting face of the drill bit, wherein the drill bit further comprises a slot defined therein the full face crown, wherein the slot extends longitudinally from the cutting face along at least a portion of the full face crown, wherein the slot extends radially inwardly from the outer surface of the full face crown, wherein the slot defines a bottom surface and an apex, and wherein the apex of the slot is positioned beyond the center of the cutting face of the drill bit such that the longitudinal axis of the drill bit extends through the bottom surface of the slot and into an interior void area of the slot.

11. A drilling system comprising:

a drill rig;

a drill string configured to be secured to and rotated by the drill rig; and a full-face impregnated drill bit having a longitudinal axis and configured to be secured to the drill string, the drill bit comprising:

a shank;

a full face crown having a cutting face and an outer surface, the full face crown and the shank cooperating to define an interior space about the longitudinal axis, wherein the cutting face is configured to contact the formation to form the hole, wherein the full face crown defines a plurality of bores extending from the cutting face to the interior space, wherein each bore comprises an outlet portion that is circumferentially surrounded by the cutting face such that the plurality of bores reduce an area of contact between the cutting face and the formation, wherein the plurality of bores are configured to direct drilling fluid directly to the cutting face from the interior space, and wherein the full face crown comprises diamonds impregnated within a matrix, wherein the full face crown of the drill bit completely circumferentially encloses the interior space of the drill bit, and wherein the full face crown of the drill bit does not comprise a waterway extending radially between the outer surface of the full face crown and the interior space.

12. The drilling system of claim 11, wherein the outer surface of the full face crown defines a plurality of channels extending radially inwardly toward the longitudinal axis.

13. The drilling system of claim 12, wherein the plurality of channels of the drill bit are substantially equally circumferentially spaced about the outer surface of the full face crown.

14. The drilling system of claim 12, wherein each channel of the plurality of channels of the drill bit has a width, and wherein the width of each channel decreases from the outer surface of the full face crown moving radially inwardly toward the longitudinal axis.

15. The drilling system of claim 12, wherein the plurality of channels of the drill bit are substantially equally sized.

16. The drilling system of claim 12, wherein at least one channel of the plurality of channels of the drill bit has a size that is different from a size of at least one other channel of the plurality of channels.

17. The drilling system of claim 12, wherein the plurality of channels of the drill bit comprise a first plurality of channels having a first size and a second plurality of channels having a second size, wherein the second size is larger than the first size, and wherein at least one channel of the first plurality of channels of the drill bit is positioned circumferentially between sequential channels of the second plurality of channels.

18. The drilling system of claim 17, wherein each channel of the first plurality of channels of the drill bit has a first radial length, wherein each channel of the second plurality of channels of the drill bit has a second radial length, and wherein the second radial length is greater than the first radial length.

19. The drilling system of claim 12, wherein the plurality of bores of the drill bit are selectively patterned about the cutting face.

20. The drilling system of claim 11, wherein the longitudinal axis of the drill bit bisects a center of the cutting face of the drill bit, wherein the drill bit further comprises a slot defined therein the full face crown, wherein the slot extends longitudinally from the cutting face along at least a portion of the full face crown, wherein the slot extends radially inwardly from the outer surface of the full face crown, wherein the slot defines a bottom surface and an apex, and wherein the apex of the slot is positioned beyond the center of the cutting face of the drill bit such that the longitudinal axis of the drill bit extends through the bottom surface of the slot and into an interior void area of the slot.

* * * * *